US010636336B2

(12) United States Patent
Huang et al.

(10) Patent No.: US 10,636,336 B2
(45) Date of Patent: Apr. 28, 2020

(54) MIXED PRIMARY DISPLAY WITH SPATIALLY MODULATED BACKLIGHT

(71) Applicant: NVIDIA Corporation, Santa Clara, CA (US)

(72) Inventors: Fu-Chung Huang, Cupertino, CA (US); David Patrick Luebke, Charlottesville, VA (US); Jan Kautz, Lexington, MA (US); Dawid Stanislaw Pajak, Mountain View, CA (US)

(73) Assignee: NVIDIA Corporation, Santa Clara, CA (US)

( * ) Notice: Subject to any disclaimer, the term of this patent is extended or adjusted under 35 U.S.C. 154(b) by 409 days.

(21) Appl. No.: 15/130,886

(22) Filed: Apr. 15, 2016

(65) Prior Publication Data

US 2016/0307482 A1 Oct. 20, 2016

Related U.S. Application Data

(60) Provisional application No. 62/149,443, filed on Apr. 17, 2015.

(51) Int. Cl.
*G09G 3/00* (2006.01)
*G09G 3/34* (2006.01)
(Continued)

(52) U.S. Cl.
CPC ..... *G09G 3/002* (2013.01); *G09G 3/001* (2013.01); *G09G 3/2003* (2013.01);
(Continued)

(58) Field of Classification Search
CPC ..... G09G 3/002; G09G 3/001; G09G 3/2003; G09G 3/2074; G09G 3/3406;
(Continued)

(56) References Cited

U.S. PATENT DOCUMENTS 5,164,848 A * 11/1992 Firth ..... G02B 27/017 359/13
5,467,154 A * 11/1995 Gale ..... G02B 27/0093 348/794

(Continued)

OTHER PUBLICATIONS

Ou-Yang, M. et al., "Design Considerations Between Color Gamut and Brightness for Multi-Primary Color Displays," Journal of Display Technology, vol. 3, No. 1, Mar. 2007, pp. 71-82.

(Continued)

*Primary Examiner* — Sejoon Ahn
(74) *Attorney, Agent, or Firm* — Leydig, Voit & Mayer, Ltd.

(57) ABSTRACT

A method, computer readable medium, and system are disclosed for generating mixed-primary data for display. The method includes the steps of receiving a source image that includes a plurality of pixels, dividing the source image into a plurality of blocks, analyzing the source image based on an image decomposition algorithm, encoding chroma information and modulation information to generate a video signal, and transmitting the video signal to a mixed-primary display. The chroma information and modulation information correspond with two or more mixed-primary color components and are generated by the image decomposition algorithm to minimize error between a reproduced image and the source image. The two or more mixed-primary colors selected for each block of the source image are not limited to any particular set of colors and each mixed-primary color component may be selected from any color capable of being reproduced by the mixed-primary display.

20 Claims, 12 Drawing Sheets

(51) Int. Cl.

| | |
|---|---|
| ***G09G 3/36*** | (2006.01) |
| ***G09G 5/36*** | (2006.01) |
| ***G09G 3/20*** | (2006.01) |
| ***G09G 5/397*** | (2006.01) |

(52) U.S. Cl.
CPC ..... *G09G 3/2074* (2013.01); *G09G 3/3406* (2013.01); *G09G 3/3433* (2013.01); *G09G 3/36* (2013.01); *G09G 5/363* (2013.01); *G09G 5/397* (2013.01); *G09G 2300/023* (2013.01); *G09G 2300/0426* (2013.01); *G09G 2340/0407* (2013.01); *G09G 2360/08* (2013.01)

(58) Field of Classification Search
CPC ..... G09G 3/3433; G09G 3/36; G09G 5/363; G09G 5/397; G09G 2300/023; G09G 2300/0426; G09G 2340/0407; G09G 2360/08
See application file for complete search history.

(56) References Cited

U.S. PATENT DOCUMENTS 5,777,588 A * 7/1998 Woodgate ..... G02B 27/2214 345/6
5,956,431 A 9/1999 Iourcha et al.
6,278,806 B1 * 8/2001 Kondo ..... G06T 3/40 382/305
6,384,809 B1 * 5/2002 Smith ..... G02F 1/133382 345/101
6,803,894 B1 * 10/2004 Hirota ..... G09G 3/3607 345/102
7,337,463 B1 * 2/2008 Rosenberg ..... H04N 21/44209 348/385.1
7,639,208 B1 * 12/2009 Ha ..... G02B 27/0172 345/204
9,640,149 B2 * 5/2017 Keramidas ..... G09G 5/39
2001/0001566 A1 * 5/2001 Moseley ..... H04N 13/351 349/15
2003/0039036 A1 * 2/2003 Kruschwitz ..... G02B 27/0927 359/707
2003/0048393 A1 * 3/2003 Sayag ..... G09G 3/3611 349/5
2004/0108973 A1 * 6/2004 Kiser ..... G02B 26/08 345/32
2005/0031199 A1 * 2/2005 Ben-Chorin ..... G09G 5/02 382/162
2005/0134527 A1 * 6/2005 Ouderkirk ..... A61C 19/004 345/32
2005/0200812 A1 * 9/2005 Sakata ..... H04N 9/315 353/20
2005/0225630 A1 * 10/2005 Childers ..... H04N 13/158 348/51
2006/0132510 A1 * 6/2006 Bell ..... G09G 3/002 345/691
2006/0221020 A1 * 10/2006 Winer ..... G09G 3/2014 345/84
2007/0285775 A1 * 12/2007 Lesage ..... G02F 1/0147 359/465
2008/0088909 A1 * 4/2008 Hui ..... G09G 3/002 359/291
2008/0117231 A1 * 5/2008 Kimpe ..... G09G 3/20 345/629
2009/0195709 A1 * 8/2009 Kwon ..... H04N 9/3111 348/750
2010/0097393 A1 * 4/2010 Yoneno ..... G03B 21/14 345/600
2010/0194938 A1 * 8/2010 Iwasa ..... H04N 5/2353 348/266
2010/0296033 A1 * 11/2010 Maeda ..... G02B 5/201 349/106
2011/0074808 A1 * 3/2011 Huang ..... G09G 5/02 345/590
2012/0224038 A1 * 9/2012 Roth ..... H04N 13/32 348/55
2013/0010229 A1 * 1/2013 Shin ..... G02F 1/133617 349/62
2014/0184669 A1 * 7/2014 Oh ..... G09G 3/3208 345/694
2016/0295178 A1 * 10/2016 Damberg ..... G03H 1/2294
2018/0330697 A1 * 11/2018 Lee ..... G09G 5/373

OTHER PUBLICATIONS

Kauvar, I. et al., "Adaptive Color Display via Perceptually-driven Factored Spectral Projection," ACM Trans. Graph. (SIG-GRAPH Asia), vol. 34, No. 6, 2015, pp. 1-10.
Langendijk, E., "A novel spectrum-sequential display design with a wide color gamut and reduced color breakup," Journal of the Society for Information Display, vol. 15, No. 4, 2007, pp. 261-266.
Cheng, Y.-K., et al., "Two-Field Scheme: Spatiotemporal Modulation for Field Sequential Color LCDs," Journal of Display Technology, vol. 5, No. 10, Oct. 2009, pp. 385-390.
Silverstein, L.D., "STColor: Hybrid Spatial-Temporal Color Synthesis for Enhanced Display Image Quality," Symposium Digest of Technical Papers, vol. 36, 2005, pp. 1112-1115.
Kalantar, K. et al., "Spatio-temporal scanning backlight mode for field-sequential-color optically-compensated-bend liquid-crystal display," Journal of the Society for Information Display, vol. 14, No. 2, 2006, pp. 151-159.
Seetzen, H. et al., "High Dynamic Range Display Systems," ACM Trans. Graph. (SIGGRAPH), vol. 23, No. 3, 2004, pp. 1-9.
Land, E., "Experiments in color vision," Scientific American, vol. 200, No. 5, 1959, pp. 1-13.
Bergquist, J. et al., "Field-Sequential-Colour Display with Adaptive Gamut," SID Symposium Digest of Technical Papers, vol. 37, No. 1, 2006, pp. 1-5.
Chan, S. et al., "LCD Motion Blur: Modeling, Analysis, and Algorithm," IEEE Transactions on Image Processing, vol. 20, No. 8, Aug. 2011, pp. 2352-2365.
Bergquist, J. "Display with Arbitrary Primary Spectra," SID 08 Digest, 2008, pp. 783-786.
Klompenhouwer, M., "Comparison of LCD Motion Blur Reduction Methods using Temporal Impulse Response and MPRT," SID Symposium Digest of Technical Papers, vol. 37, No. 1, 2006, pp. 1700-1703.
Teragawa, M. et al, "Review Paper: Multi-primary-color displays: The latest technologies and their benefits," Journal of the Society for Information Display, vol. 20, No. 1, 2012, pp. 1-11.
Pan, H. et al., "LCD Motion Blur Modeling and Analysis," IEEE ICIP, 2005, pp. 1-4.
Boyd et al., "Distributed optimization and statistical learning via the alternating direction method of multipliers," Foundations and Trends in Machine Learning, vol. 3, No. 1, 2011, pp. 1-122.

* cited by examiner

MIXED PRIMARY DISPLAY WITH SPATIALLY MODULATED BACKLIGHT

CROSS-REFERENCE TO RELATED APPLICATIONS

This application claims the benefit of U.S. Provisional Application No. 62/149,443 titled "Mixed-Primary Display with Spatially Modulated Backlight," filed Apr. 17, 2015, the entire contents of which is incorporated herein by reference

FIELD OF THE INVENTION

The present invention relates to graphics processing, and more particularly to generating image data for a mixed primary display.

BACKGROUND

Display technology has been advancing with cathode ray tube (CRT) monitors replaced with liquid crystal display (LCD), flat-panel monitors, light emitting diode (LED) backlights, and even organic LED (OLED) monitors, as well as others. Current display technology is also quickly evolving towards higher pixel densities and higher resolutions such as 4K. While these advanced technologies are impressive, manufacturing cheap monitors that implement such technologies is still a challenge. For example, the resolution and pixel densities of common, mass produced display technology is still too low for a high quality light-field display or for virtual reality headsets. While it is technically feasible to produce displays with high enough resolutions, such displays are currently expensive and require high bandwidths for communication to receive frame buffer data at frame rates of 60 Hz or higher. Such displays also typically have increased power requirements compared to current common display technology. Thus, there is a need for addressing these issues and/or other issues associated with the prior art.

SUMMARY

A method, computer readable medium, and system are disclosed for generating mixed-primary data for display. The method includes the steps of receiving a source image that includes a plurality of pixels, dividing the source image into a plurality of blocks, analyzing the source image based on an image decomposition algorithm, encoding chroma information and modulation information to generate a video signal, and transmitting the video signal to a mixed-primary display. The chroma information and modulation information correspond with two or more mixed-primary color components and are generated by the image decomposition algorithm to minimize error between a reproduced image and the source image. The two or more mixed-primary colors selected for each block of the source image are not limited to any particular set of colors and each mixed-primary color component may be selected from any color capable of being reproduced by the mixed-primary display.

DETAILED DESCRIPTION

Figure 1:
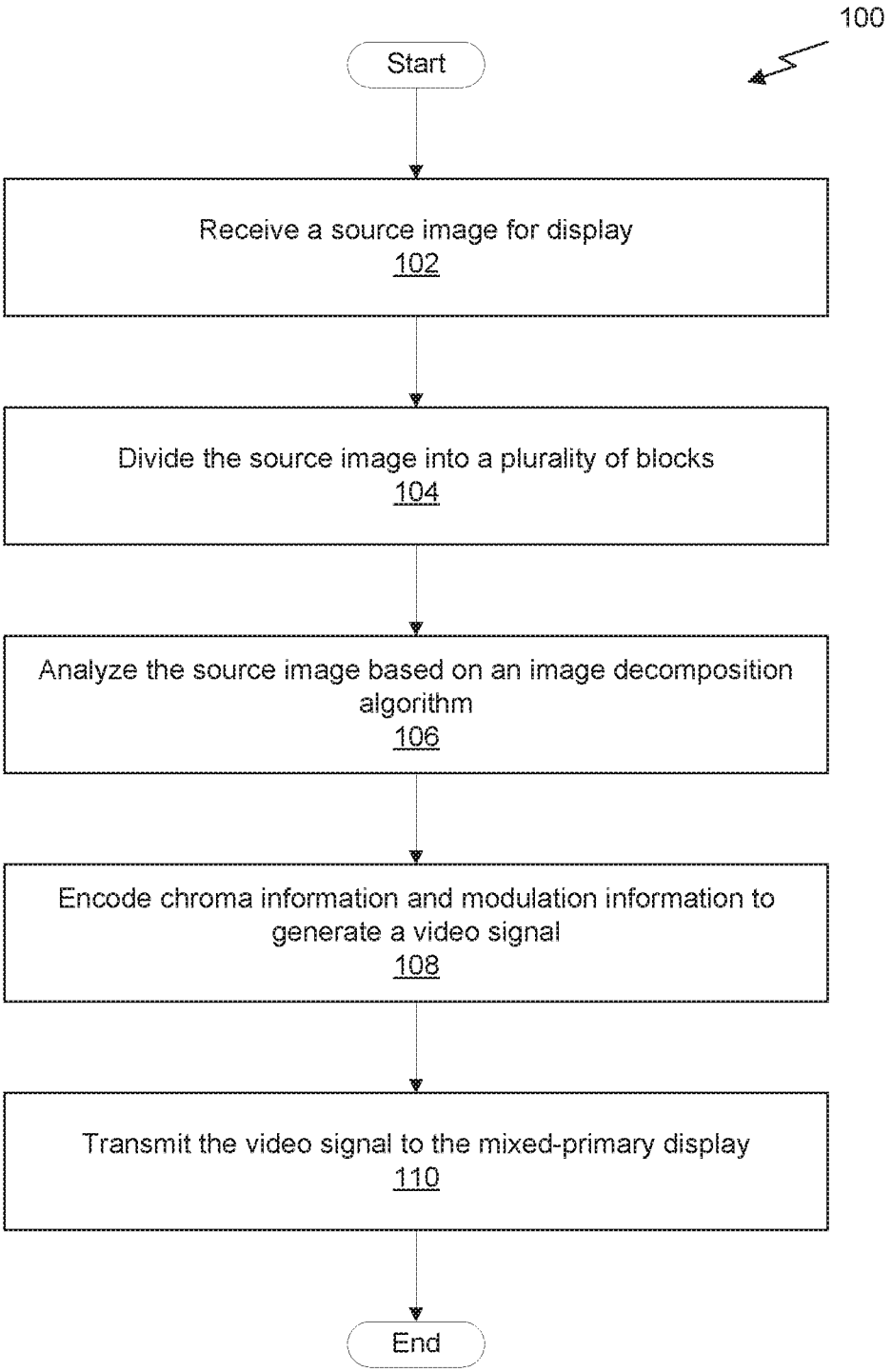
FIG. 1 illustrates a flowchart of a method for generating image data for a mixed primary display, in accordance with one embodiment.

A new display technology is proposed that exploits the physiological characteristics of the human eye, is power efficient, requires a smaller bandwidth to receive information for each frame of image data, and offers both a wide color gamut and high dynamic range. The human eye is made up of millions of photoreceptor cells, commonly referred to as rods and cones. Rods are extremely sensitive to light but are only reactive to one particular range of wavelengths and, therefore, cannot resolve colors. Rods are responsible for vision in low light conditions (i.e., night vision) and are found in higher concentrations at the periphery of the retina. Cones are not as sensitive to light, but there are three different types of cones that are sensitive to three different ranges of wavelengths. Thus, cones are used to resolve colors. The human retina contains roughly 5-6 million cones and 100 million rods. The human brain resolves images based on the signals from all of these photoreceptor cells. It is believed that colors are perceived based on differences between signals of the different cone types, similar to how CMOS-type photoreceptor sites work on an image sensor. In trichromatic vision, levels of low-wavelength, medium-wavelength, and long-wavelength signals from the different types of cones in different areas of the retina are processed to perceive particular colors.

Again, rods are responsible for seeing in low light (scotopic vision), but the rods typically have low visual acuity, making it difficult for rods to determine spatial relationships. This is partly because many rods converge into a single bipolar cell, and ganglion cell, to produce signals for the brain, which reduces the spatial resolution of signals from the rods. Cones on the other hand have a higher visual acuity because multiple cones do not converge on a single bipolar cell. The result is that the human eye is much more sensitive to luminance components of color than chrominance components of color. Studies have also shown that the brain has a tendency to discard some hue and saturation information and perceive more details based on differences in light and dark. In other words, the human eye responds more acutely to differences in luminance rather than differences in chrominance.

These differences in perception can be exploited to create a display with a higher color gamut and dynamic range than that of conventional displays. A mixed-primary display is proposed that includes a first, low-resolution layer for displaying chrominance information for an image and a second, high-resolution layer for modulating luminance at each high-resolution pixel site. Such mixed-primary displays may enable high resolution image data to be compressed for transmission at a lower bandwidth. The high resolution image data may be processed into a low resolution chrominance image and a high resolution luminance image, each image corresponding to one of the two layers of the display. Furthermore, a single image frame may be split into multiple sub-frames, each sub-frame corresponding with a particular mixed-primary color component, and then the multiple sub-frames may be displayed in quick succession such that the viewer perceives a single image.

FIG. 1 illustrates a flowchart of a method 100 for generating image data for a mixed-primary display, in accordance with one embodiment. It will be appreciated that the method 100 is described within the scope of software executed by a processor; however, in some embodiments, the method 100 may be implemented in hardware or some combination of hardware and software. The method 100 begins at step 102, where a parallel processing unit receives a source image for display. The source image may be a high resolution image that matches a resolution of a top layer of the mixed-primary display. Of course, the resolution of the source image may be pre-processed to match the resolution of the top layer of the mixed-primary display in the case that the resolution of the source image does not match. In one embodiment, the source image is received in a particular image format such as RGBA (i.e., red, green, blue, alpha). In other embodiments, the image format may be a different format, such as RGB, YUV, and the like.

At step 104, the parallel processing unit divides the source image into a plurality of blocks. In one embodiment, the image is divided into a plurality of N pixel by N pixel blocks. For example, each block may be 32 pixels by 32 pixels, 16 pixels by 16 pixels, or 4 pixels by 4 pixels. Of course, in some embodiments, the number of horizontal pixels by the number of vertical pixels may be different such that each block is N pixels by M pixels. Each block corresponds to a single pixel of a bottom layer of the mixed-primary display.

At step 106, the parallel processing unit analyzes the source image based on an image decomposition algorithm. The image decomposition algorithm may transform pixel values in a first color space into new pixel values in a second color space. The second color space may be associated with a number of mixed-primary color components. For example, pixel values for the image may be represented as a combination of three components in an RGB color space having a red primary color, a green primary color, and a blue primary color. These pixel values may be mapped to a close approximation to new pixel values represented as a combination of two components in a custom color space having two mixed-primary colors. As used herein, a mixed-primary color is any color capable of being reproduced as a combination of one or more primary colors (such as red, green, and blue).

In one embodiment, each block of the source image is associated with a different custom color space associated with two mixed-primary color components. The two mixed-primary color components for the custom color space may be any of the colors represented in the first color space (i.e., any combination of RGB values). The two mixed-primary color components that define the new color space for each block are generated as chroma information associated with the source image and then the pixel values in the source image are converted to new pixel values in the new custom color spaces for the blocks. The new pixel values will have two components that comprise the modulation information associated with the source image, each component being a value associated with one of the corresponding mixed-primary color components of the custom color space.

At step 108, the parallel processing unit encodes chroma information and modulation information derived from the image decomposition algorithm into a video signal for the mixed-primary display. The encoding may include generating a number of sub-frames, each sub-frame corresponding to one mixed-primary color component. Each sub-frame may include chroma information for specifying a particular color for the corresponding mixed-primary color component for each block. Each sub-frame may also include modulation information that identifies a level of the mixed-primary color component for each pixel of each block. At step 110, the parallel processing unit transmits the video signal to the mixed primary display.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Parallel Processing Architecture

Figure 2:
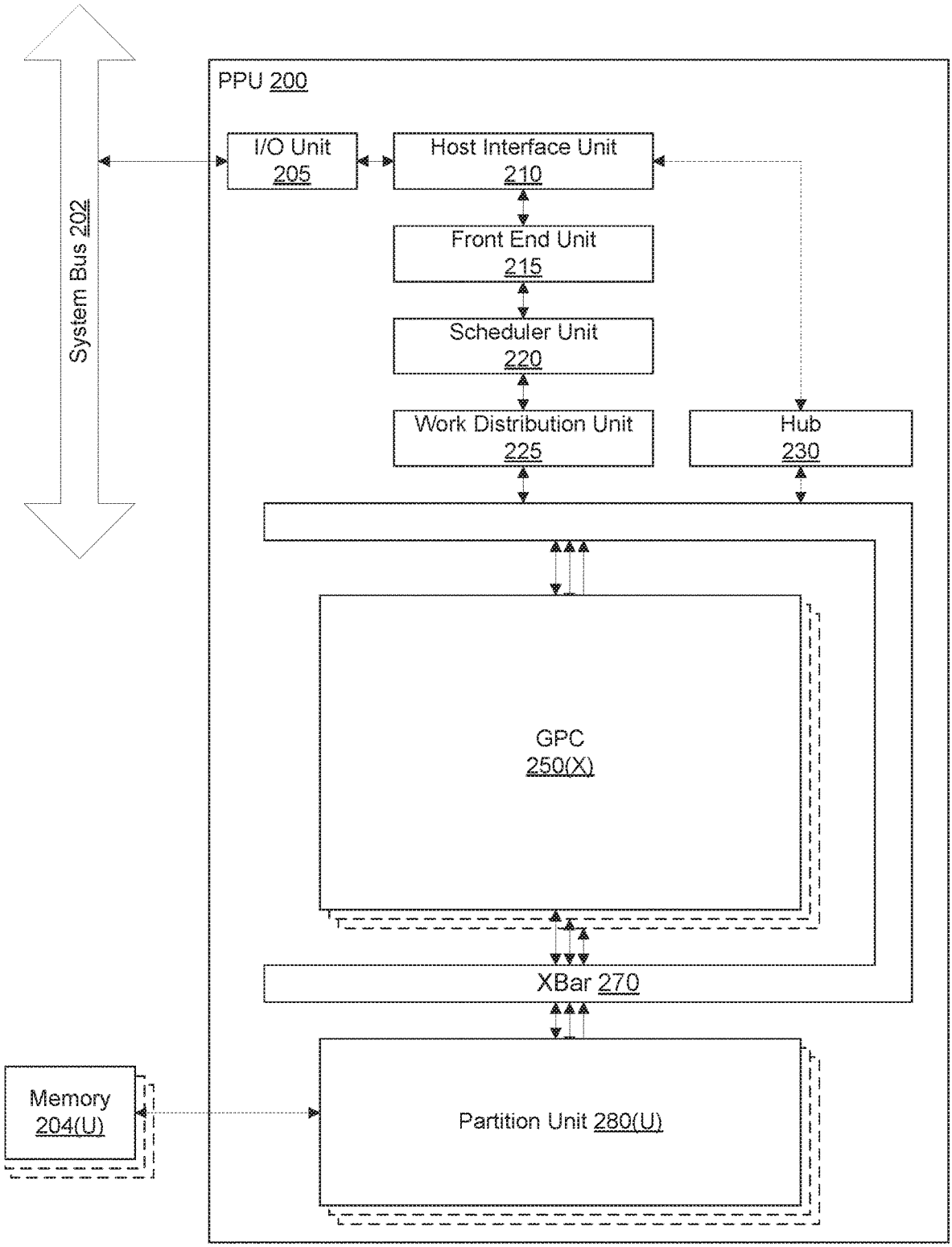
FIG. 2 illustrates a parallel processing unit (PPU), in accordance with one embodiment.

FIG. 2 illustrates a parallel processing unit (PPU) 200, in accordance with one embodiment. In one embodiment, the PPU 200 is a multi-threaded processor that is implemented on one or more integrated circuit devices. The PPU 200 is a latency hiding architecture designed to process a large number of threads in parallel. A thread (i.e., a thread of execution) is an instantiation of a set of instructions configured to be executed by the PPU 200. In one embodiment, the PPU 200 is a graphics processing unit (GPU) configured to implement a graphics rendering pipeline for processing three-dimensional (3D) graphics data in order to generate two-dimensional (2D) image data for display on a display device such as a liquid crystal display (LCD) device. In other embodiments, the PPU 200 may be utilized for performing general-purpose computations. While one exemplary parallel processor is provided herein for illustrative purposes, it should be strongly noted that such processor is set forth for illustrative purposes only, and that any processor may be employed to supplement and/or substitute for the same.

As shown in FIG. 2, the PPU 200 includes an Input/Output (I/O) unit 205, a host interface unit 210, a front end unit 215, a scheduler unit 220, a work distribution unit 225, a hub 230, a crossbar (Xbar) 270, one or more general processing clusters (GPCs) 250, and one or more partition units 280. The PPU 200 may be connected to a host processor or other peripheral devices via a system bus 202. The PPU 200 may also be connected to a local memory comprising a number of memory devices 204. In one embodiment, the local memory may comprise a number of dynamic random access memory (DRAM) devices.

The I/O unit 205 is configured to transmit and receive communications (i.e., commands, data, etc.) from a host processor (not shown) over the system bus 202. The I/O unit 205 may communicate with the host processor directly via the system bus 202 or through one or more intermediate devices such as a memory bridge. In one embodiment, the I/O unit 205 implements a Peripheral Component Interconnect Express (PCIe) interface for communications over a PCIe bus. In alternative embodiments, the I/O unit 205 may implement other types of well-known interfaces for communicating with external devices.

The I/O unit 205 is coupled to a host interface unit 210 that decodes packets received via the system bus 202. In one embodiment, the packets represent commands configured to cause the PPU 200 to perform various operations. The host interface unit 210 transmits the decoded commands to various other units of the PPU 200 as the commands may specify. For example, some commands may be transmitted to the front end unit 215. Other commands may be transmitted to the hub 230 or other units of the PPU 200 such as one or more copy engines, a video encoder, a video decoder, a power management unit, etc. (not explicitly shown). In other words, the host interface unit 210 is configured to route communications between and among the various logical units of the PPU 200.

In one embodiment, a program executed by the host processor encodes a command stream in a buffer that provides workloads to the PPU 200 for processing. A workload may comprise a number of instructions and data to be processed by those instructions. The buffer is a region in a memory that is accessible (i.e., read/write) by both the host processor and the PPU 200. For example, the host interface unit 210 may be configured to access the buffer in a system memory connected to the system bus 202 via memory requests transmitted over the system bus 202 by the I/O unit 205. In one embodiment, the host processor writes the command stream to the buffer and then transmits a pointer to the start of the command stream to the PPU 200. The host interface unit 210 provides the front end unit 215 with pointers to one or more command streams. The front end unit 215 manages the one or more streams, reading commands from the streams and forwarding commands to the various units of the PPU 200.

The front end unit 215 is coupled to a scheduler unit 220 that configures the various GPCs 250 to process tasks defined by the one or more streams. The scheduler unit 220 is configured to track state information related to the various tasks managed by the scheduler unit 220. The state may indicate which GPC 250 a task is assigned to, whether the task is active or inactive, a priority level associated with the task, and so forth. The scheduler unit 220 manages the execution of a plurality of tasks on the one or more GPCs 250.

The scheduler unit 220 is coupled to a work distribution unit 225 that is configured to dispatch tasks for execution on the GPCs 250. The work distribution unit 225 may track a number of scheduled tasks received from the scheduler unit 220. In one embodiment, the work distribution unit 225 manages a pending task pool and an active task pool for each of the GPCs 250. The pending task pool may comprise a number of slots (e.g., 32 slots) that contain tasks assigned to be processed by a particular GPC 250. The active task pool may comprise a number of slots (e.g., 4 slots) for tasks that are actively being processed by the GPCs 250. As a GPC 250 finishes the execution of a task, that task is evicted from the active task pool for the GPC 250 and one of the other tasks from the pending task pool is selected and scheduled for execution on the GPC 250. If an active task has been idle on the GPC 250, such as while waiting for a data dependency to be resolved, then the active task may be evicted from the GPC 250 and returned to the pending task pool while another task in the pending task pool is selected and scheduled for execution on the GPC 250.

The work distribution unit 225 communicates with the one or more GPCs 250 via XBar 270. The XBar 270 is an interconnect network that couples many of the units of the PPU 200 to other units of the PPU 200. For example, the XBar 270 may be configured to couple the work distribution unit 225 to a particular GPC 250. Although not shown explicitly, one or more other units of the PPU 200 are coupled to the host unit 210. The other units may also be connected to the XBar 270 via a hub 230.

The tasks are managed by the scheduler unit 220 and dispatched to a GPC 250 by the work distribution unit 225. The GPC 250 is configured to process the task and generate results. The results may be consumed by other tasks within the GPC 250, routed to a different GPC 250 via the XBar 270, or stored in the memory 204. The results can be written to the memory 204 via the partition units 280, which implement a memory interface for reading and writing data to/from the memory 204. In one embodiment, the PPU 200 includes a number U of partition units 280 that is equal to the number of separate and distinct memory devices 204 coupled to the PPU 200. A partition unit 280 will be described in more detail below in conjunction with FIG. 3B.

In one embodiment, a host processor executes a driver kernel that implements an application programming interface (API) that enables one or more applications executing on the host processor to schedule operations for execution on the PPU 200. An application may generate instructions (i.e., API calls) that cause the driver kernel to generate one or more tasks for execution by the PPU 200. The driver kernel outputs tasks to one or more streams being processed by the PPU 200. Each task may comprise one or more groups of related threads, referred to herein as a warp. A thread block may refer to a plurality of groups of threads including instructions to perform the task. Threads in the same group of threads may exchange data through shared memory. In one embodiment, a group of threads comprises 32 related threads.

Figure 3A:
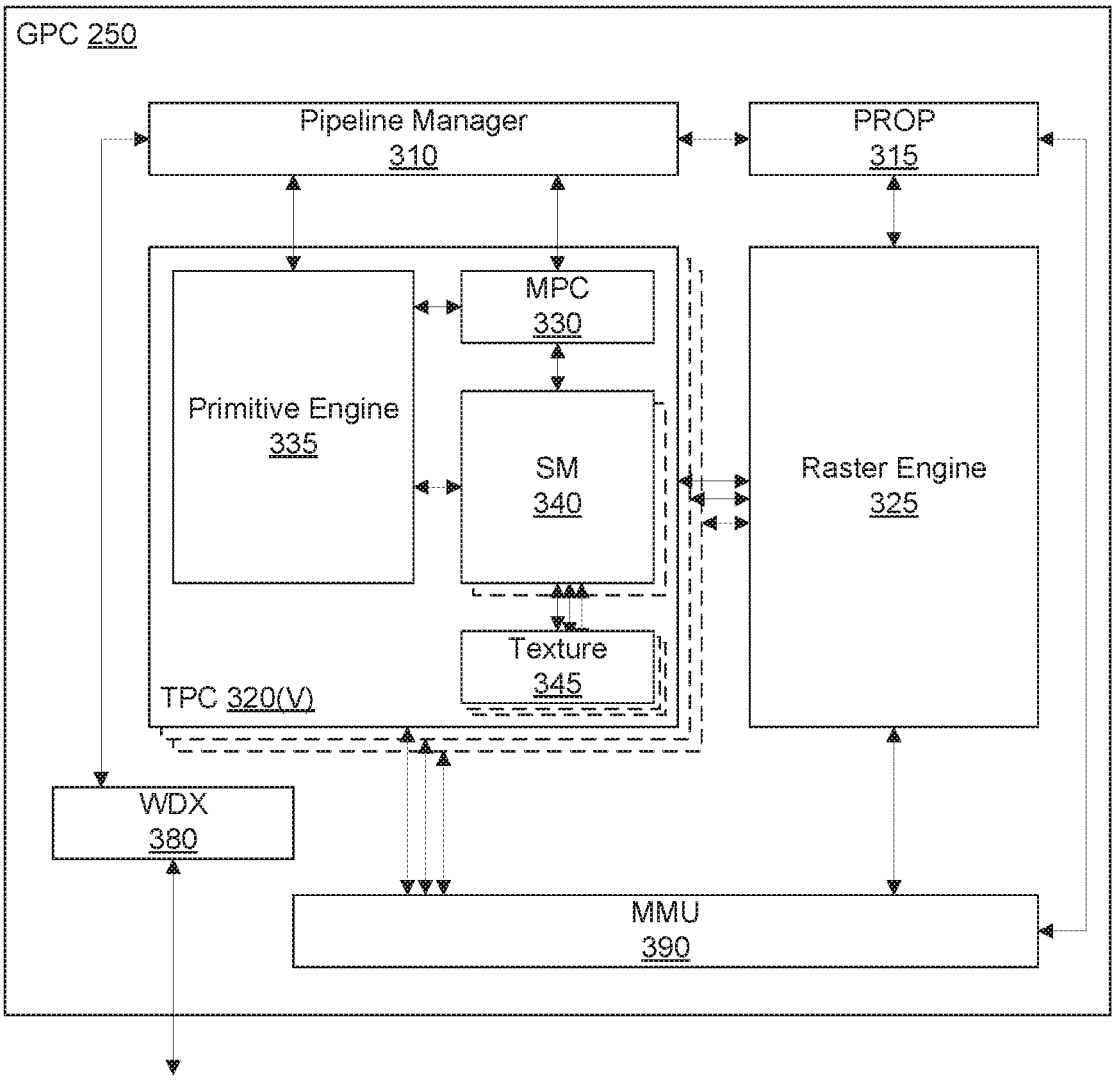
FIG. 3A illustrates a general processing cluster of the PPU of FIG. 2, in accordance with one embodiment.

FIG. 3A illustrates a GPC 250 of the PPU 200 of FIG. 2, in accordance with one embodiment. As shown in FIG. 3A, each GPC 250 includes a number of hardware units for processing tasks. In one embodiment, each GPC 250 includes a pipeline manager 310, a pre-raster operations unit (PROP) 315, a raster engine 325, a work distribution crossbar (WDX) 380, a memory management unit (MMU) 390, and one or more Texture Processing Clusters (TPCs) 320. It will be appreciated that the GPC 250 of FIG. 3A may include other hardware units in lieu of or in addition to the units shown in FIG. 3A.

In one embodiment, the operation of the GPC 250 is controlled by the pipeline manager 310. The pipeline manager 310 manages the configuration of the one or more TPCs 320 for processing tasks allocated to the GPC 250. In one embodiment, the pipeline manager 310 may configure at least one of the one or more TPCs 320 to implement at least a portion of a graphics rendering pipeline. For example, a TPC 320 may be configured to execute a vertex shader program on the programmable streaming multiprocessor (SM) 340. The pipeline manager 310 may also be configured to route packets received from the work distribution unit 225 to the appropriate logical units within the GPC 250. For example, some packets may be routed to fixed function hardware units in the PROP 315 and/or raster engine 325 while other packets may be routed to the TPCs 320 for processing by the primitive engine 335 or the SM 340.

The PROP unit 315 is configured to route data generated by the raster engine 325 and the TPCs 320 to a Raster Operations (ROP) unit in the partition unit 280, described in more detail below. The PROP unit 315 may also be configured to perform optimizations for color blending, organize pixel data, perform address translations, and the like.

The raster engine 325 includes a number of fixed function hardware units configured to perform various raster operations. In one embodiment, the raster engine 325 includes a setup engine, a course raster engine, a culling engine, a clipping engine, a fine raster engine, and a tile coalescing engine. The setup engine receives transformed vertices and generates plane equations associated with the geometric primitive defined by the vertices. The plane equations are transmitted to the coarse raster engine to generate coverage information (e.g., an x,y coverage mask for a tile) for the primitive. The output of the coarse raster engine may transmitted to the culling engine where fragments associated with the primitive that fail a z-test are culled, and transmitted to a clipping engine where fragments lying outside a viewing frustum are clipped. Those fragments that survive clipping and culling may be passed to a fine raster engine to generate attributes for the pixel fragments based on the plane equations generated by the setup engine. The output of the raster engine 325 comprises fragments to be processed, for example, by a fragment shader implemented within a TPC 320.

Each TPC 320 included in the GPC 250 includes an M-Pipe Controller (MPC) 330, a primitive engine 335, one or more SMs 340, and one or more texture units 345. The MPC 330 controls the operation of the TPC 320, routing packets received from the pipeline manager 310 to the appropriate units in the TPC 320. For example, packets associated with a vertex may be routed to the primitive engine 335, which is configured to fetch vertex attributes associated with the vertex from the memory 204. In contrast, packets associated with a shader program may be transmitted to the SM 340.

In one embodiment, the texture units 345 are configured to load texture maps (e.g., a 2D array of texels) from the memory 204 and sample the texture maps to produce sampled texture values for use in shader programs executed by the SM 340. The texture units 345 implement texture operations such as filtering operations using mip-maps (i.e., texture maps of varying levels of detail). The texture unit 345 is also used as the Load/Store path for SM 340 to MMU 390. In one embodiment, each TPC 320 includes two (2) texture units 345.

The SM 340 comprises a programmable streaming processor that is configured to process tasks represented by a number of threads. Each SM 340 is multi-threaded and configured to execute a plurality of threads (e.g., 32 threads) from a particular group of threads concurrently. In one embodiment, the SM 340 implements a SIMD (Single-Instruction, Multiple-Data) architecture where each thread in a group of threads (i.e., a warp) is configured to process a different set of data based on the same set of instructions. All threads in the group of threads execute the same instructions. In another embodiment, the SM 340 implements a SIMT (Single-Instruction, Multiple Thread) architecture where each thread in a group of threads is configured to process a different set of data based on the same set of instructions, but where individual threads in the group of threads are allowed to diverge during execution. In other words, when an instruction for the group of threads is dispatched for execution, some threads in the group of threads may be active, thereby executing the instruction, while other threads in the group of threads may be inactive, thereby performing a no-operation (NOP) instead of executing the instruction. The SM 340 may be described in more detail below in conjunction with FIG. 4.

The MMU 390 provides an interface between the GPC 250 and the partition unit 280. The MMU 390 may provide translation of virtual addresses into physical addresses, memory protection, and arbitration of memory requests. In one embodiment, the MMU 390 provides one or more translation lookaside buffers (TLBs) for improving translation of virtual addresses into physical addresses in the memory 204.

Figure 3B:
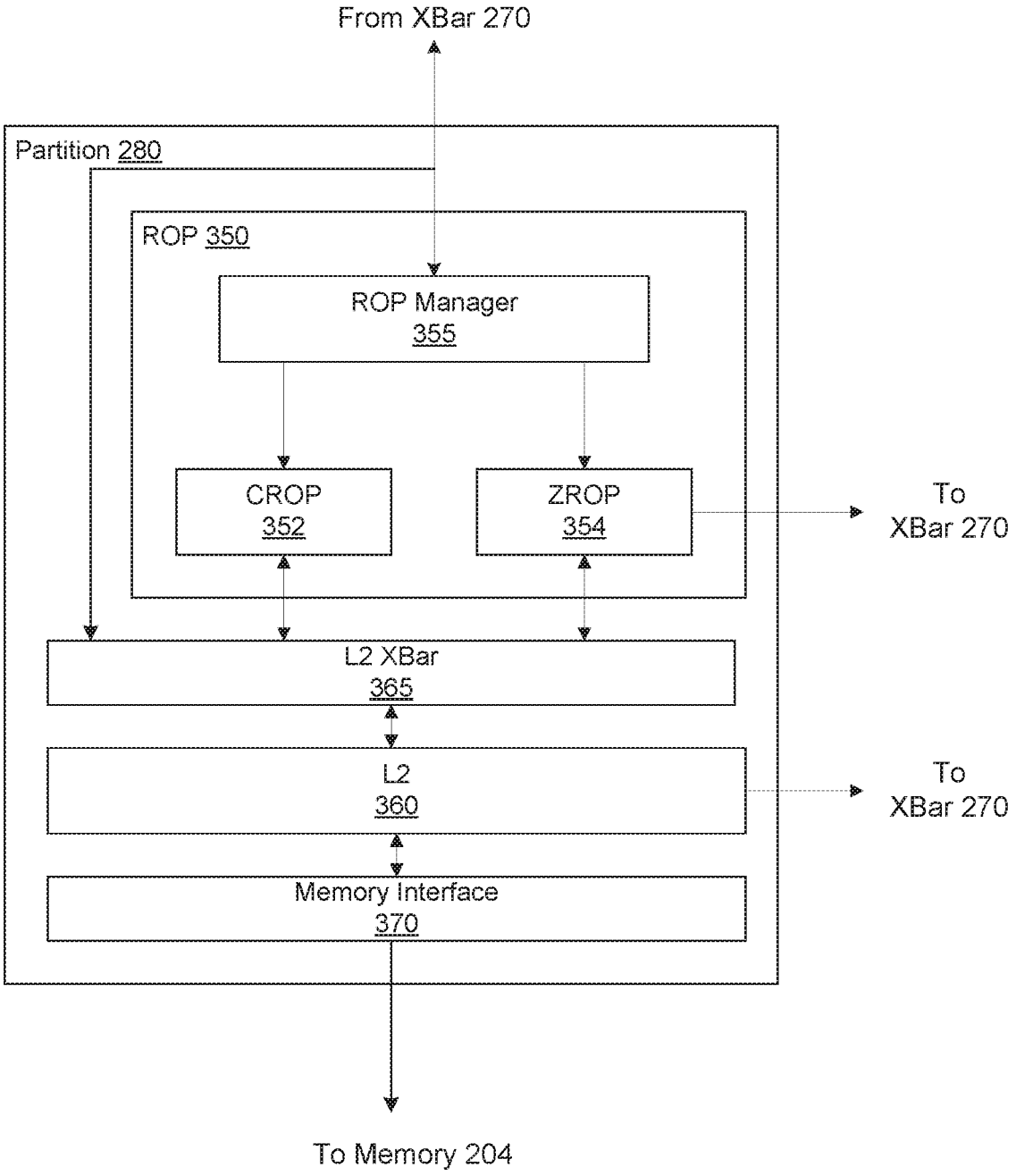
FIG. 3B illustrates a partition unit of the PPU of FIG. 2, in accordance with one embodiment.

FIG. 3B illustrates a partition unit 280 of the PPU 200 of FIG. 2, in accordance with one embodiment. As shown in FIG. 3B, the partition unit 280 includes a Raster Operations (ROP) unit 350, a level two (L2) cache 360, a memory interface 370, and an L2 crossbar (XBar) 365. The memory interface 370 is coupled to the memory 204. Memory interface 370 may implement 16, 32, 64, 128-bit data buses, or the like, for high-speed data transfer. In one embodiment, the PPU 200 comprises U memory interfaces 370, one memory interface 370 per partition unit 280, where each partition unit 280 is connected to a corresponding memory device 204. For example, PPU 200 may be connected to up to U memory devices 204, such as graphics double-data-rate, version 5, synchronous dynamic random access memory (GDDR5 SDRAM). In one embodiment, the memory interface 370 implements a DRAM interface and U is equal to 8.

In one embodiment, the PPU 200 implements a multi-level memory hierarchy. The memory 204 is located off-chip in SDRAM coupled to the PPU 200. Data from the memory 204 may be fetched and stored in the L2 cache 360, which is located on-chip and is shared between the various GPCs 250. As shown, each partition unit 280 includes a portion of the L2 cache 360 associated with a corresponding memory device 204. Lower level caches may then be implemented in various units within the GPCs 250. For example, each of the SMs 340 may implement a level one (L1) cache. The L1 cache is private memory that is dedicated to a particular SM 340. Data from the L2 cache 360 may be fetched and stored in each of the L1 caches for processing in the functional units of the SMs 340. The L2 cache 360 is coupled to the memory interface 370 and the XBar 270.

The ROP unit 350 includes a ROP Manager 355, a Color ROP (CROP) unit 352, and a Z ROP (ZROP) unit 354. The CROP unit 352 performs raster operations related to pixel color, such as color compression, pixel blending, and the like. The ZROP unit 354 implements depth testing in conjunction with the raster engine 325. The ZROP unit 354 receives a depth for a sample location associated with a pixel fragment from the culling engine of the raster engine 325. The ZROP unit 354 tests the depth against a corresponding depth in a depth buffer for a sample location associated with the fragment. If the fragment passes the depth test for the sample location, then the ZROP unit 354 updates the depth buffer and transmits a result of the depth test to the raster engine 325. The ROP Manager 355 controls the operation of the ROP unit 350. It will be appreciated that the number of partition units 280 may be different than the number of GPCs 250 and, therefore, each ROP unit 350 may be coupled to each of the GPCs 250. Therefore, the ROP Manager 355 tracks packets received from the different GPCs 250 and determines which GPC 250 that a result generated by the ROP unit 350 is routed to. The CROP unit 352 and the ZROP unit 354 are coupled to the L2 cache 360 via an L2 XBar 365.

Figure 4:
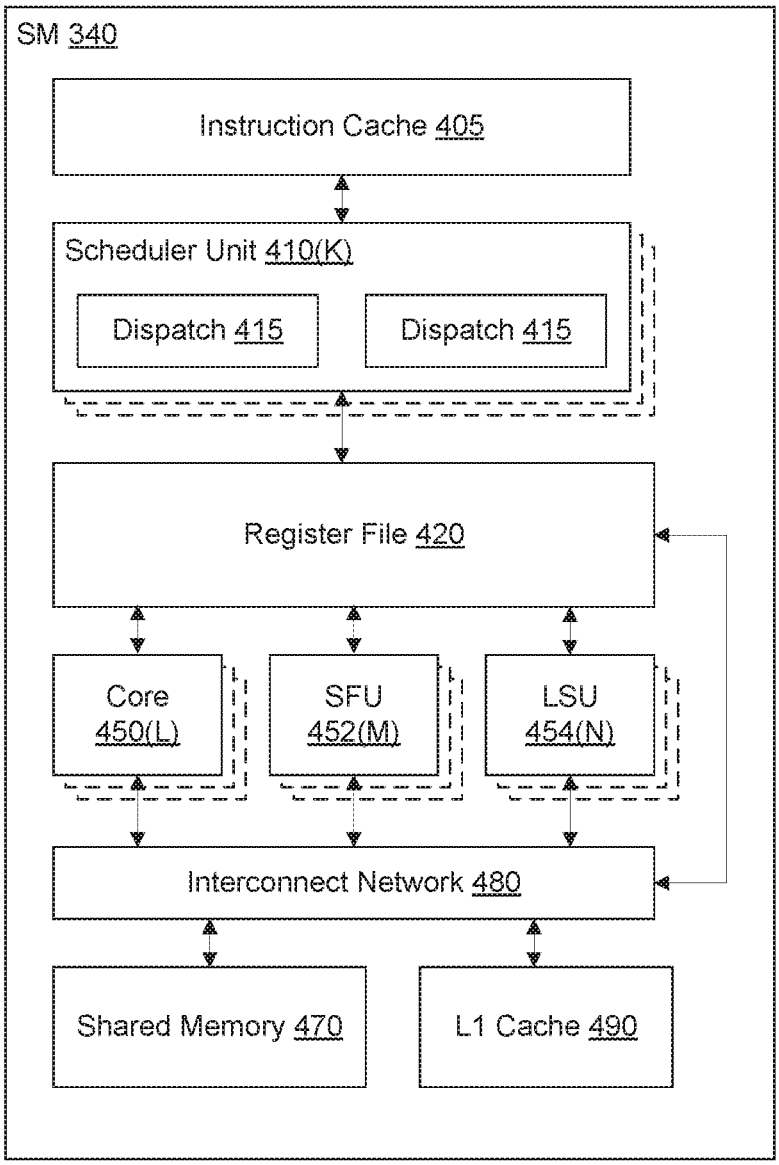
FIG. 4 illustrates the streaming multi-processor of FIG. 3A, in accordance with one embodiment.

FIG. 4 illustrates the streaming multi-processor 340 of FIG. 3A, in accordance with one embodiment. As shown in FIG. 4, the SM 340 includes an instruction cache 405, one or more scheduler units 410, a register file 420, one or more processing cores 450, one or more special function units (SFUs) 452, one or more load/store units (LSUs) 454, an interconnect network 480, a shared memory 470 and an L1 cache 490.

As described above, the work distribution unit 225 dispatches tasks for execution on the GPCs 250 of the PPU 200. The tasks are allocated to a particular TPC 320 within a GPC 250 and, if the task is associated with a shader program, the task may be allocated to an SM 340. The scheduler unit 410 receives the tasks from the work distribution unit 225 and manages instruction scheduling for one or more groups of threads (i.e., warps) assigned to the SM 340. The scheduler unit 410 schedules threads for execution in groups of parallel threads, where each group is called a warp. In one embodiment, each warp includes 32 threads. The scheduler unit 410 may manage a plurality of different warps, scheduling the warps for execution and then dispatching instructions from the plurality of different warps to the various functional units (i.e., cores 350, SFUs 352, and LSUs 354) during each clock cycle.

In one embodiment, each scheduler unit 410 includes one or more instruction dispatch units 415. Each dispatch unit 415 is configured to transmit instructions to one or more of the functional units. In the embodiment shown in FIG. 4, the scheduler unit 410 includes two dispatch units 415 that enable two different instructions from the same warp to be dispatched during each clock cycle. In alternative embodiments, each scheduler unit 410 may include a single dispatch unit 415 or additional dispatch units 415.

Each SM 340 includes a register file 420 that provides a set of registers for the functional units of the SM 340. In one embodiment, the register file 420 is divided between each of the functional units such that each functional unit is allocated a dedicated portion of the register file 420. In another embodiment, the register file 420 is divided between the different warps being executed by the SM 340. The register file 420 provides temporary storage for operands connected to the data paths of the functional units.

Each SM 340 comprises L processing cores 450. In one embodiment, the SM 340 includes a large number (e.g., 128, etc.) of distinct processing cores 450. Each core 450 may include a fully-pipelined, single-precision processing unit that includes a floating point arithmetic logic unit and an integer arithmetic logic unit. The core 450 may also include a double-precision processing unit including a floating point arithmetic logic unit. In one embodiment, the floating point arithmetic logic units implement the IEEE 754-2008 standard for floating point arithmetic. Each SM 340 also comprises A SFUs 452 that perform special functions (e.g., attribute evaluation, reciprocal square root, and the like), and N LSUs 454 that implement load and store operations between the shared memory 470 or L1 cache 490 and the register file 420. In one embodiment, the SM 340 includes 128 cores 450, 32 SFUs 452, and 32 LSUs 454.

Each SM 340 includes an interconnect network 480 that connects each of the functional units to the register file 420 and the LSU 454 to the register file 420, shared memory 470 and L1 cache 490. In one embodiment, the interconnect network 480 is a crossbar that can be configured to connect any of the functional units to any of the registers in the register file 420 and connect the LSUs 454 to the register file and memory locations in shared memory 470 and L1 cache 490.

The shared memory 470 is an array of on-chip memory that allows for data storage and communication between the SM 340 and the primitive engine 335 and between threads in the SM 340. In one embodiment, the shared memory 470 comprises 64 KB of storage capacity. An L1 cache 490 is in the path from the SM 340 to the partition unit 280. The L1 cache 490 can be used to cache reads and writes. In one embodiment, the L1 cache 490 comprises 24 KB of storage capacity.

The PPU 200 described above may be configured to perform highly parallel computations much faster than conventional CPUs. Parallel computing has advantages in graphics processing, data compression, biometrics, stream processing algorithms, and the like.

When configured for general purpose parallel computation, a simpler configuration can be used. In this model, as shown in FIG. 2, fixed function graphics processing units are bypassed, creating a much simpler programming model. In this configuration, the Work Distribution Unit 225 assigns and distributes blocks of threads directly to the TPCs 320. The threads in a block execute the same program, using a unique thread ID in the calculation to ensure each thread generates unique results, using the SM 340 to execute the program and perform calculations, shared memory 470 communicate between threads, and the LSU 454 to read and write Global memory through partition L1 cache 490 and partition unit 280.

When configured for general purpose parallel computation, the SM 340 can also write commands that scheduler unit 220 can use to launch new work on the TPCs 320.

In one embodiment, the PPU 200 comprises a graphics processing unit (GPU). The PPU 200 is configured to receive commands that specify shader programs for processing graphics data. Graphics data may be defined as a set of primitives such as points, lines, triangles, quads, triangle strips, and the like. Typically, a primitive includes data that specifies a number of vertices for the primitive (e.g., in a model-space coordinate system) as well as attributes associated with each vertex of the primitive. The PPU 200 can be configured to process the graphics primitives to generate a frame buffer (i.e., pixel data for each of the pixels of the display).

An application writes model data for a scene (i.e., a collection of vertices and attributes) to a memory such as a system memory or memory 204. The model data defines each of the objects that may be visible on a display. The application then makes an API call to the driver kernel that requests the model data to be rendered and displayed. The driver kernel reads the model data and writes commands to the one or more streams to perform operations to process the model data. The commands may reference different shader programs to be implemented on the SMs 340 of the PPU 200 including one or more of a vertex shader, hull shader, domain shader, geometry shader, and a pixel shader. For example, one or more of the SMs 340 may be configured to execute a vertex shader program that processes a number of vertices defined by the model data. In one embodiment, the different SMs 340 may be configured to execute different shader programs concurrently. For example, a first subset of SMs 340 may be configured to execute a vertex shader program while a second subset of SMs 340 may be configured to execute a pixel shader program. The first subset of SMs 340 processes vertex data to produce processed vertex data and writes the processed vertex data to the L2 cache 360 and/or the memory 204. After the processed vertex data is rasterized (i.e., transformed from three-dimensional data into two-dimensional data in screen space) to produce fragment data, the second subset of SMs 340 executes a pixel shader to produce processed fragment data, which is then blended with other processed fragment data and written to the frame buffer in memory 204. The vertex shader program and pixel shader program may execute concurrently, processing different data from the same scene in a pipelined fashion until all of the model data for the scene has been rendered to the frame buffer. Then, the contents of the frame buffer are transmitted to a display controller for display on a display device.

The PPU 200 may be included in a desktop computer, a laptop computer, a tablet computer, a smart-phone (e.g., a wireless, hand-held device), personal digital assistant (PDA), a digital camera, a hand-held electronic device, and the like. In one embodiment, the PPU 200 is embodied on a single semiconductor substrate. In another embodiment, the PPU 200 is included in a system-on-a-chip (SoC) along with one or more other logic units such as a reduced instruction set computer (RISC) CPU, a memory management unit (MMU), a digital-to-analog converter (DAC), and the like.

In one embodiment, the PPU 200 may be included on a graphics card that includes one or more memory devices 204 such as GDDR5 SDRAM. The graphics card may be configured to interface with a PCIe slot on a motherboard of a desktop computer that includes, e.g., a northbridge chipset and a southbridge chipset. In yet another embodiment, the PPU 200 may be an integrated graphics processing unit (iGPU) included in the chipset (i.e., Northbridge) of the motherboard.

Figure 5:
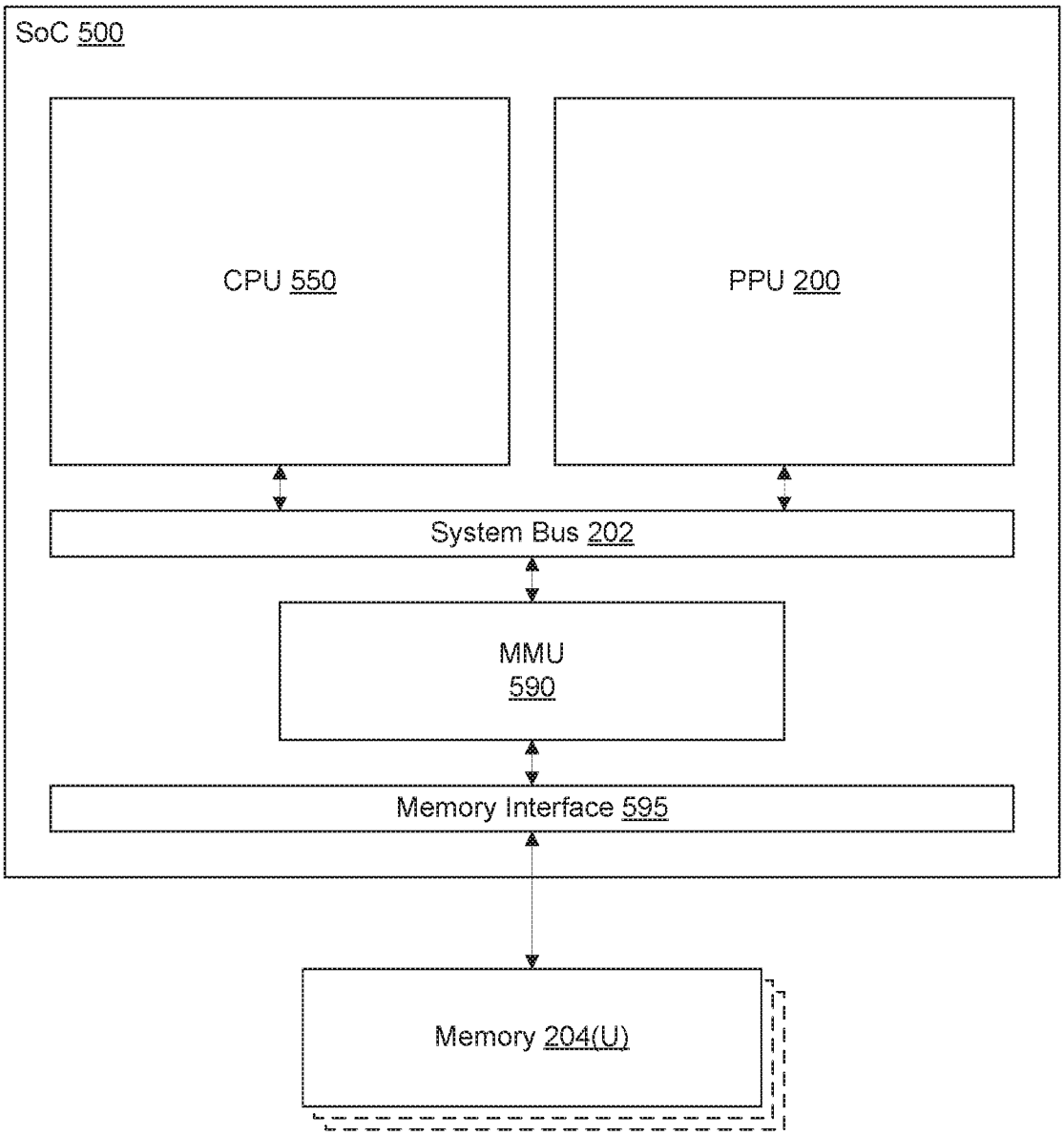
FIG. 5 illustrates a system-on-chip including the PPU of FIG. 2, in accordance with one embodiment.

FIG. 5 illustrates a System-on-Chip (SoC) 500 including the PPU 200 of FIG. 2, in accordance with one embodiment. As shown in FIG. 5, the SoC 500 includes a CPU 550 and a PPU 200, as described above. The SoC 500 may also include a system bus 202 to enable communication between the various components of the SoC 500. Memory requests generated by the CPU 550 and the PPU 200 may be routed through a system MMU 590 that is shared by multiple components of the SoC 500. The SoC 500 may also include a memory interface 595 that is coupled to one or more memory devices 204. The memory interface 595 may implement, e.g., a DRAM interface.

Although not shown explicitly, the SoC 500 may include other components in addition to the components shown in FIG. 5. For example, the SoC 500 may include multiple PPUs 200 (e.g., four PPUs 200), a video encoder/decoder, and a wireless broadband transceiver as well as other components. In one embodiment, the SoC 500 may be included with the memory 204 in a package-on-package (PoP) configuration.

Figure 6:
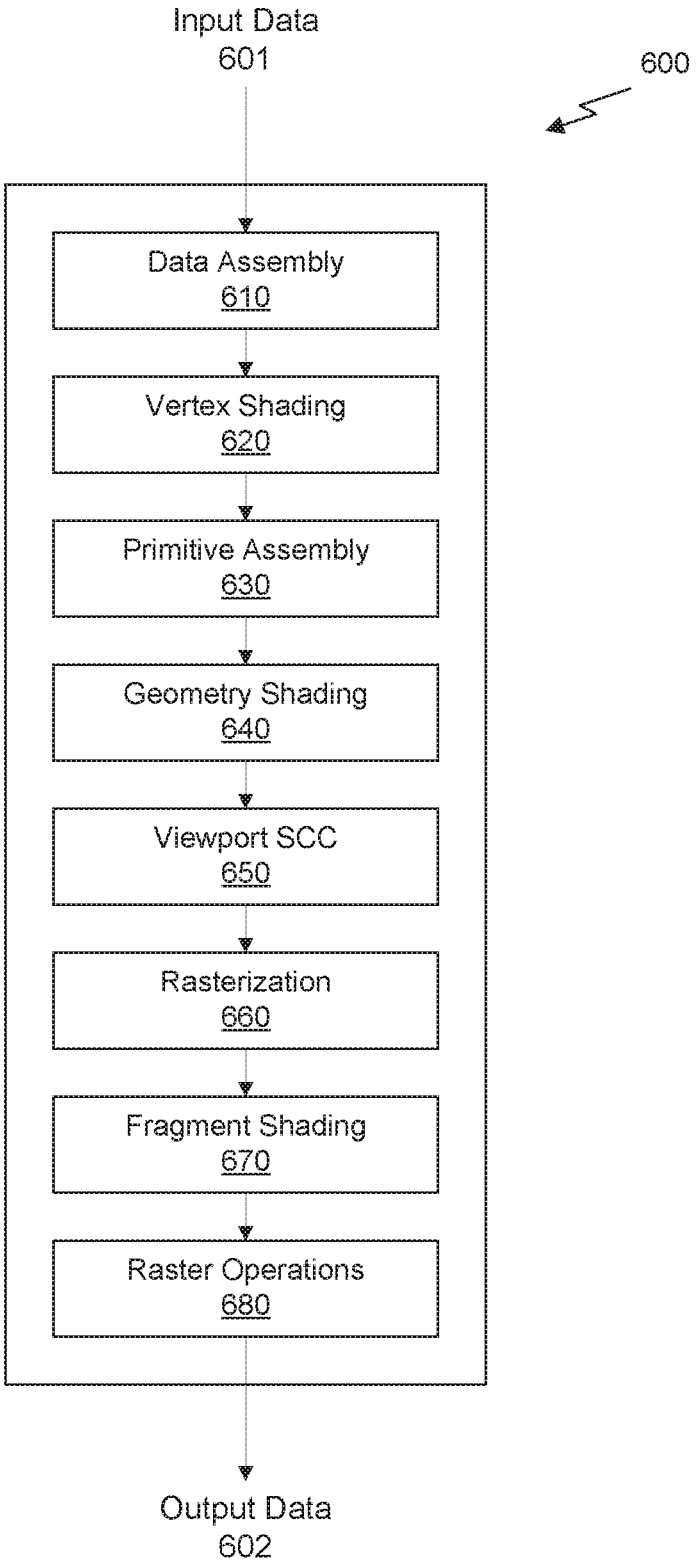
FIG. 6 is a conceptual diagram of a graphics processing pipeline implemented by the PPU of FIG. 2, in accordance with one embodiment.

FIG. 6 is a conceptual diagram of a graphics processing pipeline 600 implemented by the PPU 200 of FIG. 2, in accordance with one embodiment. The graphics processing pipeline 600 is an abstract flow diagram of the processing steps implemented to generate 2D computer-generated images from 3D geometry data. As is well-known, pipeline architectures may perform long latency operations more efficiently by splitting up the operation into a plurality of stages, where the output of each stage is coupled to the input of the next successive stage. Thus, the graphics processing pipeline 600 receives input data 601 that is transmitted from one stage to the next stage of the graphics processing pipeline 600 to generate output data 602. In one embodiment, the graphics processing pipeline 600 may represent a graphics processing pipeline defined by the OpenGL® API. As an option, the graphics processing pipeline 600 may be implemented in the context of the functionality and architecture of the previous Figures and/or any subsequent Figure(s).

As shown in FIG. 6, the graphics processing pipeline 600 comprises a pipeline architecture that includes a number of stages. The stages include, but are not limited to, a data assembly stage 610, a vertex shading stage 620, a primitive assembly stage 630, a geometry shading stage 640, a viewport scale, cull, and clip (VSCC) stage 650, a rasterization stage 660, a fragment shading stage 670, and a raster operations stage 680. In one embodiment, the input data 601 comprises commands that configure the processing units to implement the stages of the graphics processing pipeline 600 and geometric primitives (e.g., points, lines, triangles, quads, triangle strips or fans, etc.) to be processed by the stages. The output data 602 may comprise pixel data (i.e., color data) that is copied into a frame buffer or other type of surface data structure in a memory.

The data assembly stage 610 receives the input data 601 that specifies vertex data for high-order surfaces, primitives, or the like. The data assembly stage 610 collects the vertex data in a temporary storage or queue, such as by receiving a command from the host processor that includes a pointer to a buffer in memory and reading the vertex data from the buffer. The vertex data is then transmitted to the vertex shading stage 620 for processing.

The vertex shading stage 620 processes vertex data by performing a set of operations (i.e., a vertex shader or a program) once for each of the vertices. Vertices may be, e.g., specified as a 4-coordinate vector (i.e., <x, y, z, w>) associated with one or more vertex attributes (e.g., color, texture coordinates, surface normal, etc.). The vertex shading stage 620 may manipulate individual vertex attributes such as position, color, texture coordinates, and the like. In other words, the vertex shading stage 620 performs operations on the vertex coordinates or other vertex attributes associated with a vertex. Such operations commonly including lighting operations (i.e., modifying color attributes for a vertex) and transformation operations (i.e., modifying the coordinate space for a vertex). For example, vertices may be specified using coordinates in an object-coordinate space, which are transformed by multiplying the coordinates by a matrix that translates the coordinates from the object-coordinate space into a world space or a normalized-device-coordinate (NCD) space. The vertex shading stage 620 generates transformed vertex data that is transmitted to the primitive assembly stage 630.

The primitive assembly stage 630 collects vertices output by the vertex shading stage 620 and groups the vertices into geometric primitives for processing by the geometry shading stage 640. For example, the primitive assembly stage 630 may be configured to group every three consecutive vertices as a geometric primitive (i.e., a triangle) for transmission to the geometry shading stage 640. In some embodiments, specific vertices may be reused for consecutive geometric primitives (e.g., two consecutive triangles in a triangle strip may share two vertices). The primitive assembly stage 630 transmits geometric primitives (i.e., a collection of associated vertices) to the geometry shading stage 640.

The geometry shading stage 640 processes geometric primitives by performing a set of operations (i.e., a geometry shader or program) on the geometric primitives. Tessellation operations may generate one or more geometric primitives from each geometric primitive. In other words, the geometry shading stage 640 may subdivide each geometric primitive into a finer mesh of two or more geometric primitives for processing by the rest of the graphics processing pipeline 600. The geometry shading stage 640 transmits geometric primitives to the viewport SCC stage 650.

In one embodiment, the graphics processing pipeline 600 may operate within a streaming multiprocessor and the vertex shading stage 620, the primitive assembly stage 630, the geometry shading stage 640, the fragment shading stage 670, and/or hardware/software associated therewith, may sequentially perform processing operations. Once the sequential processing operations are complete, in one embodiment, the viewport SCC stage 650 may utilize the data. In one embodiment, primitive data processed by one or more of the stages in the graphics processing pipeline 600 may be written to a cache (e.g. L1 cache, a vertex cache, etc.). In this case, in one embodiment, the viewport SCC stage 650 may access the data in the cache. In one embodiment, the viewport SCC stage 650 and the rasterization stage 660 are implemented as fixed function circuitry.

The viewport SCC stage 650 performs viewport scaling, culling, and clipping of the geometric primitives. Each surface being rendered to is associated with an abstract camera position. The camera position represents a location of a viewer looking at the scene and defines a viewing frustum that encloses the objects of the scene. The viewing frustum may include a viewing plane, a rear plane, and four clipping planes. Any geometric primitive entirely outside of the viewing frustum may be culled (i.e., discarded) because the geometric primitive will not contribute to the final rendered scene. Any geometric primitive that is partially inside the viewing frustum and partially outside the viewing frustum may be clipped (i.e., transformed into a new geometric primitive that is enclosed within the viewing frustum. Furthermore, geometric primitives may each be scaled based on a depth of the viewing frustum. All potentially visible geometric primitives are then transmitted to the rasterization stage 660.

The rasterization stage 660 converts the 3D geometric primitives into 2D fragments (e.g. capable of being utilized for display, etc.). The rasterization stage 660 may be configured to utilize the vertices of the geometric primitives to setup a set of plane equations from which various attributes can be interpolated. The rasterization stage 660 may also compute a coverage mask for a plurality of pixels that indicates whether one or more sample locations for the pixel intercept the geometric primitive. In one embodiment, z-testing may also be performed to determine if the geometric primitive is occluded by other geometric primitives that have already been rasterized. The rasterization stage 660 generates fragment data (i.e., interpolated vertex attributes associated with a particular sample location for each covered pixel) that are transmitted to the fragment shading stage 670.

The fragment shading stage 670 processes fragment data by performing a set of operations (i.e., a fragment shader or a program) on each of the fragments. The fragment shading stage 670 may generate pixel data (i.e., color values) for the fragment such as by performing lighting operations or sampling texture maps using interpolated texture coordinates for the fragment. The fragment shading stage 670 generates pixel data that is transmitted to the raster operations stage 680.

The raster operations stage 680 may perform various operations on the pixel data such as performing alpha tests, stencil tests, and blending the pixel data with other pixel data corresponding to other fragments associated with the pixel. When the raster operations stage 680 has finished processing the pixel data (i.e., the output data 602), the pixel data may be written to a render target such as a frame buffer, a color buffer, or the like.

It will be appreciated that one or more additional stages may be included in the graphics processing pipeline 600 in addition to or in lieu of one or more of the stages described above. Various implementations of the abstract graphics processing pipeline may implement different stages. Furthermore, one or more of the stages described above may be excluded from the graphics processing pipeline in some embodiments (such as the geometry shading stage 640). Other types of graphics processing pipelines are contemplated as being within the scope of the present disclosure. Furthermore, any of the stages of the graphics processing pipeline 600 may be implemented by one or more dedicated hardware units within a graphics processor such as PPU 200. Other stages of the graphics processing pipeline 600 may be implemented by programmable hardware units such as the SM 340 of the PPU 200.

The graphics processing pipeline 600 may be implemented via an application executed by a host processor, such as a CPU 550. In one embodiment, a device driver may implement an application programming interface (API) that defines various functions that can be utilized by an application in order to generate graphical data for display. The device driver is a software program that includes a plurality of instructions that control the operation of the PPU 200. The API provides an abstraction for a programmer that lets a programmer utilize specialized graphics hardware, such as the PPU 200, to generate the graphical data without requiring the programmer to utilize the specific instruction set for the PPU 200. The application may include an API call that is routed to the device driver for the PPU 200. The device driver interprets the API call and performs various operations to respond to the API call. In some instances, the device driver may perform operations by executing instructions on the CPU 550. In other instances, the device driver may perform operations, at least in part, by launching operations on the PPU 200 utilizing an input/output interface between the CPU 550 and the PPU 200. In one embodiment, the device driver is configured to implement the graphics processing pipeline 600 utilizing the hardware of the PPU 200.

Various programs may be executed within the PPU 200 in order to implement the various stages of the graphics processing pipeline 600. For example, the device driver may launch a kernel on the PPU 200 to perform the vertex shading stage 620 on one SM 340 (or multiple SMs 340). The device driver (or the initial kernel executed by the PPU 200) may also launch other kernels on the PPU 200 to perform other stages of the graphics processing pipeline 600, such as the geometry shading stage 640 and the fragment shading stage 670. In addition, some of the stages of the graphics processing pipeline 600 may be implemented on fixed unit hardware such as a rasterizer or a data assembler implemented within the PPU 200. It will be appreciated that results from one kernel may be processed by one or more intervening fixed function hardware units before being processed by a subsequent kernel on an SM 340.

Mixed-Primary Displays

Figure 7A:
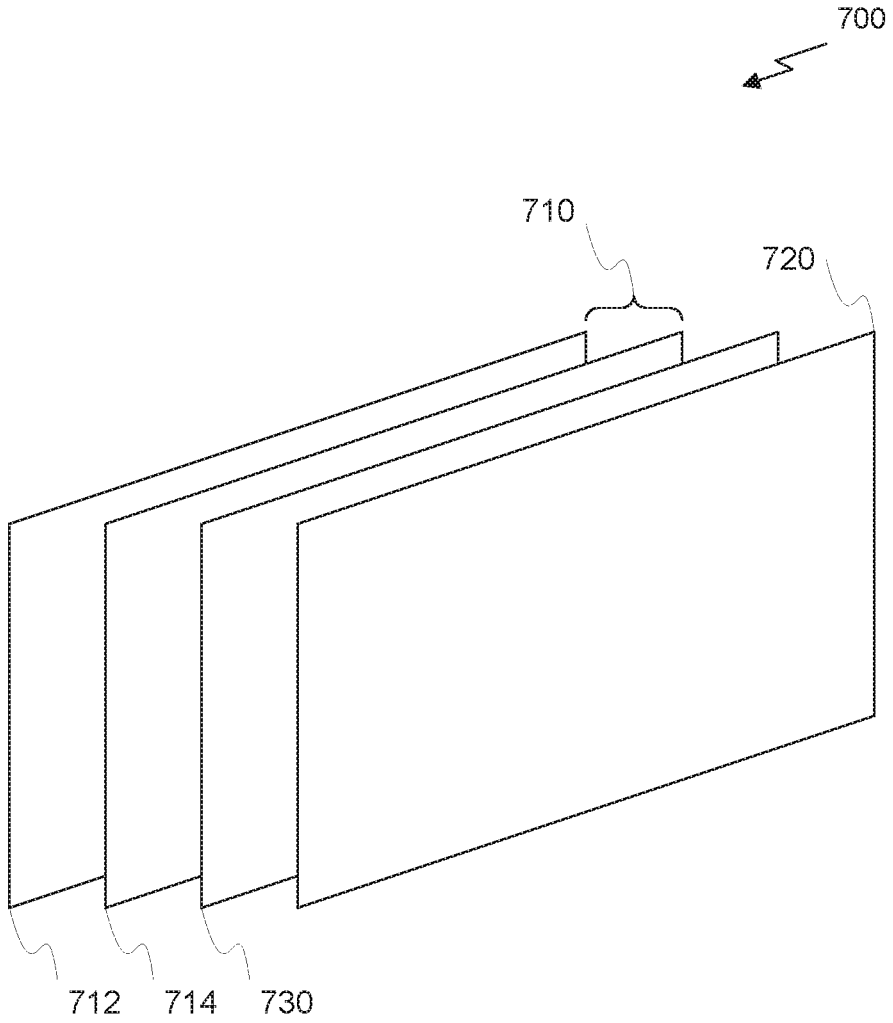
FIG. 7A illustrates a mixed primary display, in accordance with one embodiment.

FIG. 7A illustrates a mixed-primary display 700, in accordance with one embodiment. As shown in FIG. 7, the mixed-primary display 700 includes a low-resolution layer 710 and a high-resolution layer 720. The low-resolution layer 710 is configured to reproduce chroma information associated with an image. In one embodiment, the low-resolution layer 710 includes a backlight layer 712 and a modulation layer 714. The backlight layer 712 may be a source of monochromatic light, such as white light provided by CFLs and the modulation layer 714 may be an array of monochromatic liquid crystal elements with a color filter array integrated therein. Each liquid crystal element may be overlaid by a color filter of a different primary color, such as in a Bayer filter. In such embodiments, the low-resolution layer 710 may be similar to common, low cost LCD displays. In another embodiment, the backlight layer 712 may be an array of monochromatic LEDs that may utilize local dimming technology to increase contrast and/or dynamic range of the low-resolution layer 710. In yet another embodiment, the backlight layer 712 may be an array of color LEDs (e.g., red, green, and blue LEDs) arranged to produce different mixed-primary colors, and the modulation layer 714 may be a corresponding array of monochromatic LCDs utilized to modulate the light from each of the corresponding backlight LEDs.

In another embodiment, the low-resolution layer 710 is an array of OLEDs. Each OLED in the array of OLEDs may be manufactured to generate a different primary color, such that multiple adjacent OLEDs can produce light that approximates a color blended from the multiple primary colors. Unlike LEDs, which are hard to modulate based on voltage alone, and are used with an array of liquid crystal elements in order to modulate the light transmitted through each pixel, OLEDs can be modulated independently much more accurately and, therefore, do not require a separate backlight and modulation layer.

The low-resolution layer 710 is configured to reproduce chroma information associated with an image. In one embodiment, each pixel element of the low-resolution layer 710 corresponds to a single block of an image that is divided into a plurality of blocks. In other words, each pixel element of the low-resolution layer 710 corresponds to a plurality of adjacent pixels in a high resolution image reproduced on the display 700. In contrast, the high-resolution layer 720 is configured to modulate the light projected through the low-resolution layer 710 to adjust a luminance of light transmitted through each pixel element in the second layer.

In one embodiment, the high-resolution layer 720 is an array of monochromatic liquid crystal elements. Each pixel element of the high-resolution layer 720 has a smaller pitch than corresponding pixel elements of the low-resolution layer 710. In other words, the resolution (in pixels per inch) of the high-resolution layer 720 is greater than the resolution (in pixels per inch) of the low-resolution layer 710. In addition, there is no color filter array associated with the high-resolution layer 720 as the liquid crystal elements in the high-resolution layer 720 are merely controlled to modulate the luminance of light transmitted through the high-resolution layer 720 from the low-resolution layer 710.

In one embodiment, the display 700 may also include a diffusion layer 730 that is positioned between the low-resolution layer 710 and the high-resolution layer 720. The diffusion layer 730 may be a sheet (or sheets) of at least partially translucent material that promotes scattering of light transmitted through the low-resolution layer 710. The diffusion layer 730 may help blend light transmitted through distinct pixel elements of the modulation layer 714 with light transmitted through adjacent pixel elements of the modulation layer 714 to reduce artifacts at the borders of pixel elements in the low-resolution layer 710 from affecting the image perceived by a viewer.

Figure 7B:
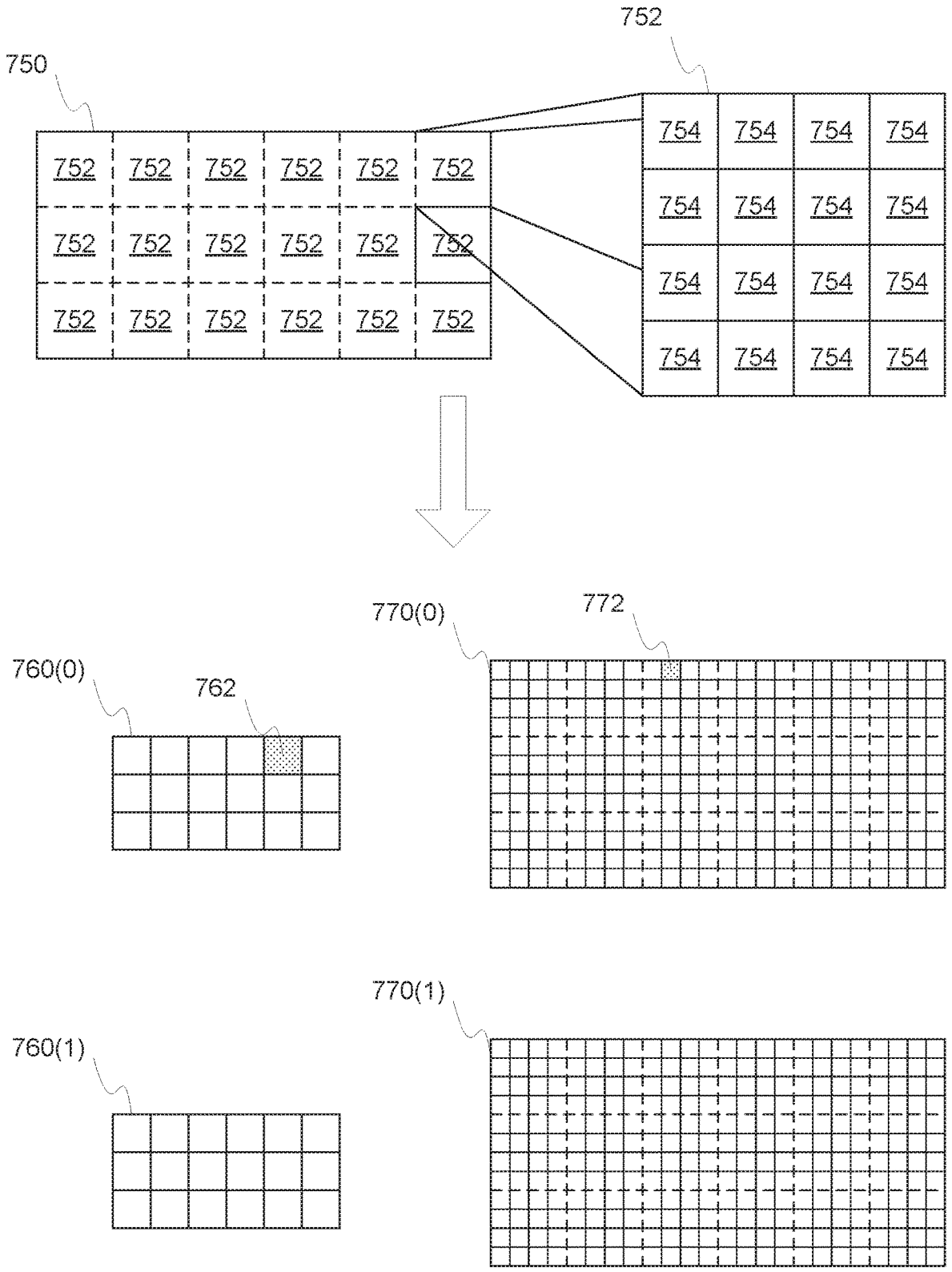
FIG. 7B illustrates a technique for displaying images on the mixed primary display using temporal multiplexing, in accordance with one embodiment.

FIG. 7B illustrates a technique for displaying images on the mixed-primary display 700 using temporal multiplexing, in accordance with one embodiment. As shown in FIG. 7B, a source image 750 is received, and the source image 750 is divided into a plurality of blocks 752. Each block 752 is an N×N array of pixels 754 of the source image. Although a block 752 is shown as having 16 pixels 754 in a 4×4 array of pixels 754, the number of pixels 754 included in each block 752 may vary. Each block 752 is then analyzed using an image decomposition algorithm to determine a set of mixed-primary color components for each pixel element of the low-resolution layer 710 as well as modulation values for each corresponding pixel element of the high-resolution layer 720. In one embodiment, the image decomposition algorithm includes an augmented Non-negative Matrix Factorization (NMF) algorithm that is implemented using the PPU 200. The augmented NMF algorithm will be discussed in more detail below.

By way of illustration, two mixed-primary colors will be chosen for each block 752 by finding a plane in an RGB scattergram that best fits the pixel values in the block 752 of the source image 750. Each axis of the RGB scattergram represents one of the red, green, or blue primary colors of the RGB color space. The pixel values for all pixels 754 in each block 752 may be plotted on an RGB scattergram corresponding to the block 752. A plane may then be fit to the pixel values. The plane that best fits the pixel values may be defined by two color lines. A color line represents a fixed ratio between all three components of a pixel value in the RGB color space. In other words, the hue and saturation of all colors on the color line will be the same but the value or brightness of the color will change. The two colors represented by the color lines that define the best-fit planes for each block 752 of pixel values may be selected as the two mixed-primary color components for the corresponding block 752.

A number of chroma images 760 corresponding to the number of mixed-primary color components may be generated. In the case where the mixed-primary display using temporal multiplexing utilizes two mixed-primary color components, two chroma images 760 are generated. A first chroma image 760(0) encodes one color value per block 752 of the source image 750 in a 2D array having a resolution that matches the resolution of the low-resolution layer 710. In other words, each pixel 762 in the chroma image 760 corresponds to a block 752 of the source image 750. The color values stored in the first chroma image 760(0) correspond to a first mixed-primary color component of the two mixed-primary color components selected for each block 752. A second chroma image 760(1) encodes one color value per block 752 of the source image 750 in a 2D array having a resolution that matches the resolution of the low-resolution layer 710. The color values stored in the second chroma image 760(1) correspond to a second mixed-primary color component of the two mixed-primary color components selected for each block 752.

Once the mixed-primary color components have been selected for each block 752, each pixel value for pixels 754 of the source image 750 may be converted into a new pixel value in a new color space. A new color space is defined for each block 752 based on the two mixed-primary color components selected for the block 752. Thus, each pixel value for pixels 754 in a particular block 752 may be converted into a pixel value in the new color space for the block 752. Essentially, the pixel value in the new color space is derived by projecting the RGB values onto the color lines in the RGB scattergram. The projected RGB values intersect the color lines at a point on the color lines that defines a luminance component corresponding to the mixed-primary color component represented by that color line.

A number of modulation images 770 corresponding to the number of mixed-primary color components may be generated. In the case where the mixed-primary display using temporal multiplexing utilizes two mixed-primary color components, two modulation images 770 are generated. A first modulation image 770(0) encodes one modulation value per pixel 754 of the source image 750 in a 2D array having a resolution that matches the resolution of the high-resolution layer 720. In other words, each pixel 772 in the modulation image 770 corresponds to a pixel 754 of the source image 750. The modulation values stored in the first modulation image 770(0) correspond to a luminance component for a pixel 754 associated with the first mixed-primary color component in the new color space. A second modulation image 770(1) encodes one modulation value per pixel 754 of the source image 750 in a 2D array having a resolution that matches the resolution of the high-resolution layer 720. The modulation values stored in the second modulation image 770(1) correspond to a luminance component for a pixel 754 associated with the second mixed-primary color component in the new color space.

It will be appreciated that the description above is for illustration only as pixel values are not actually plotted on an RGB scattergram, pixel values are not converted to a new color space by projecting a value in one color space onto the color lines within the scattergram, and so forth. In actuality, the chroma images 760 and modulation images 770 are generated using the image decomposition algorithm, as described below. The image decomposition algorithm attempts to generate the chroma information and modulation information in parallel to minimize the error between the source image 750 and a reproduced image generated based on the chroma information and modulation information. The above description is simply provided to assist in a conceptual understanding of the theory of operation of the mixed-primary display 700 using temporal multiplexing.

Once the chroma images 760 and modulation images 770 have been generated, the source image 750 may be reproduced on the display 700 using temporal multiplexing. It will be appreciated that each pixel element of the low-resolution layer 710 of the display 700 may reproduce one color per block per sub-frame, and that each pixel element of the high-resolution layer 720 of the display 700 may vary the luminance of the color of the corresponding pixel in the low-resolution layer 710. In other words, the high-resolution layer 720 varies the luminance for each pixel 754 of the image 750 for a shared chrominance across all pixels of the block 752. Over a plurality of sub-frames corresponding to each of the two or more mixed-primary color components, the perceived image produced by the display 700 will substantially match the source image 750.

For example, in order to generate pixels based on two mixed-primary color components, two sub-frames may be displayed in quick succession. First, a first sub-frame is displayed where the low-resolution layer 710 of the display 700 is driven based on the first chroma image 760(0) and the high-resolution layer 720 of the display 700 is driven based on the first modulation image 770(0). Thus, each pixel of the display 700 will display a single color, based on the color produced by the corresponding pixel (or pixels based on diffusion) of the low-resolution layer 710, modulated to different levels of luminance. Then, a second sub-frame is displayed where the low-resolution layer 710 of the display 700 is driven based on the second chroma image 760(1) and the high-resolution layer 720 of the display 700 is driven based on the second modulation image 770(1). As long as the frame rate of the display (i.e., a number of frames, including all sub-frames, displayed each second) is above a minimum flicker frequency of approximately 60 Hz, the visual perception of the two sub-frames will blend the two displayed colors together and the viewer will perceive a color that approximates the color in the source image 750. In one embodiment, the display 700 may be operated at 120 Hz such that sub-frames are refreshed approximately every 8 ms, and the perceived image and video is observed at a frame rate of 60 Hz.

In another embodiment, more than two mixed-primary color components may be selected for each block 752 of the source image 750. For example, the image decomposition algorithm may select three mixed-primary color components for each block 752 and then the pixel values of each block 752 may be converted to new pixel values having three mixed-primary color components. The simplest iteration of this scheme would be to select pure red, green, and blue primary colors and then display, in succession, a red chroma image 760(0) along with a red modulation image 770(0) as a first sub-frame, a green chroma image 760(1) along with a green modulation image 770(1) as a second sub-frame, and a blue chroma image 760(2) along with a blue modulation image 770(2) as a third sub-frame. Again, care should be taken to ensure that the frame rate is sufficiently high that a viewer will not perceive flicker from changing between the sub-frames for each mixed-primary color component.

At first glance, the ability to support three different mixed-primary colors might seem pointless compared to traditional field-sequential color (FSC) display technology that displays pure red, pure green, and pure blue primary sub-frames to reconstruct a full frame. However, a mixed-primary approach that uses adaptive selection of color based on the content of the frame has significant benefits such as extending the color gamut of the display to include brighter and more saturated colors over the traditional FSC technology. For example, to display white on a traditional FSC display, a first frame of red, then a second frame of blue, and then a third frame of green are displayed, with the total brightness of the display being the sum of the output of the three sub-frames. In comparison, a pure white pixel could be displayed in the mixed-primary display by displaying a white pixel in all three sub-frames, achieving approximately three times the brightness of the FSC technology. The same could be done with other colors as well.

It will be appreciated that each pixel 762 in the chroma image 760 includes a value for a color to be reproduced by the low-resolution layer 710. Each pixel element of the low-resolution layer 710 may be, e.g., a set of RGB liquid crystal elements that may be driven to generate a range of different colors. As described above, traditional FSC technology will display a single color for a full frame, which is then modulated per pixel to change the luminance for that particular primary color. In contrast, the low-resolution layer 710 may display any color at each distinct pixel, thus enabling different mixed-primary color components to be selected for each block 752 of the image 750. Thus, the entire sub-frame is not a constant color across the whole display 700 but is instead constant only across each block 752 of the image 750. The smaller the size of the blocks 752, the more accurately colors of the source image 750 may be reproduced. This accuracy is derived because the best two mixed-primary color components can be selected based on the pixel values in the block 752 of the source image 750. Real images typically exhibit a small number of colors within a local region of the image, therefore, it will be unusual where a small number of pixels cannot be accurately reproduced by blending two mixed-primary color components rather than three primary colors, especially when those mixed-primary color components can be adaptively selected based on the content of the image 750 within the block 752.

Another advantage of using the mixed-primary display is that the effective precision that is achievable with the display technology is increased. For example, a monochromatic attenuation display panel may include up to 16 different grey levels with 4 bits of precision. However, by mixing different grey levels over two sub-frames enables up to 31 grey levels to be achieved, effectively doubling the precision of the panel. This is similar to dithering between two colors to achieve a higher bit depth. Using different relative sub-frame durations for the two (or more) sub-frames will enable even more precision to be realized.

Liquid crystal elements have a particular response time where the liquid crystals twist in response to a provided input. The response of the liquid crystals results in a gradual change in the color output, which can produce a noticeable effect when the display is refreshed at high refresh frequencies such as 120 Hz. In order to combat these effects, in one embodiment, the persistence of the backlight layer 712 may be modulated to turn off the backlight when sub-frames are changed and turn on the backlight when the liquid crystals in the modulation layer 714 have settled. For example, when a sub-frame duration corresponds to 8 ms, the backlight may be turned off for 4 ms while the liquid crystals are updated and then the backlight may be turned on for 4 ms while the sub-frame is displayed. This may reduce the overall brightness of the display but increase the accuracy of the perceived image.

Figure 8:
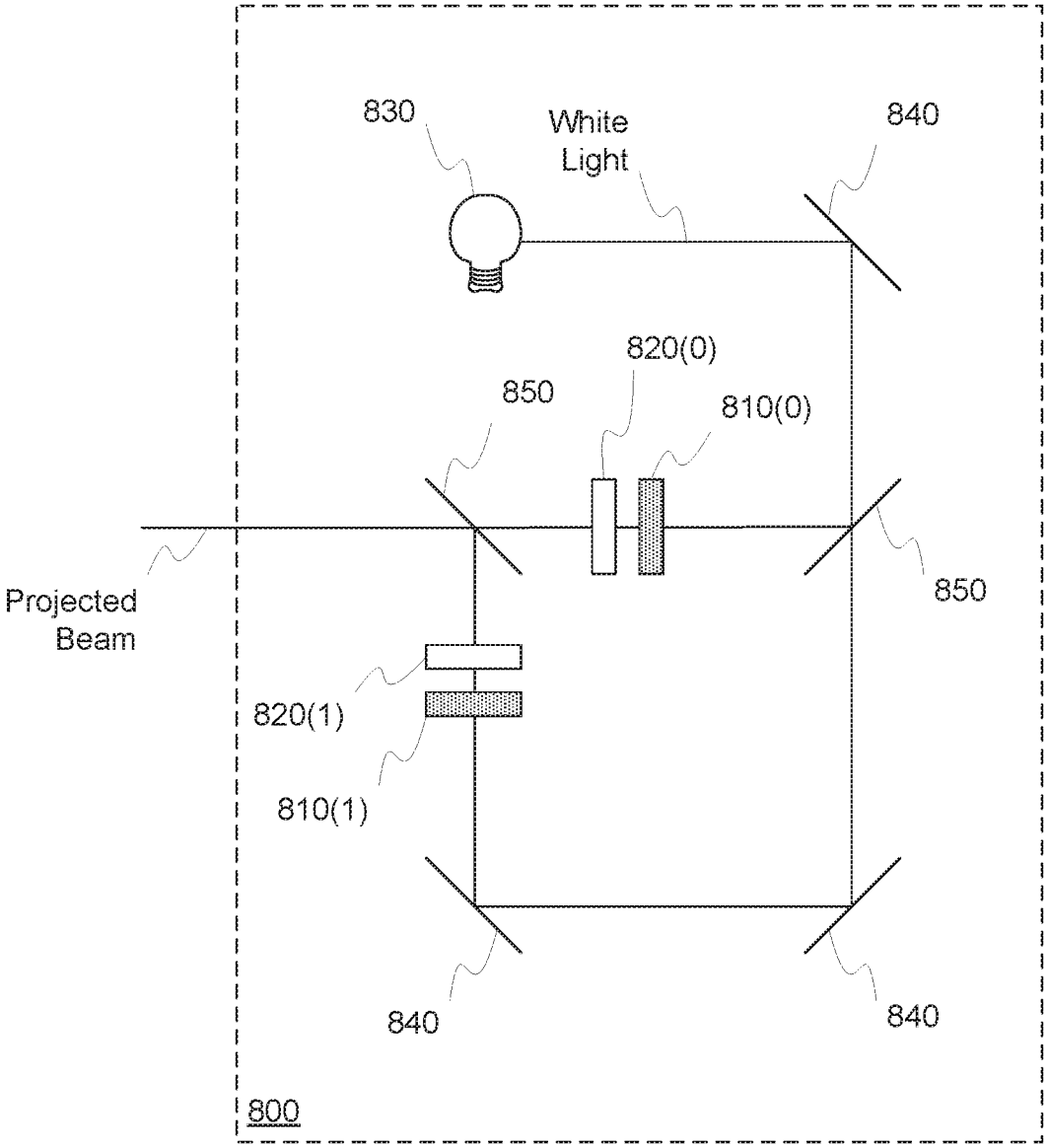
FIG. 8 illustrates a mixed primary display, in accordance with one embodiment.

FIG. 8 illustrates a mixed-primary display 800, in accordance with one embodiment. The display 800 is a projection system that projects an image against a screen (not explicitly shown). The display includes two RGB LCD panels 810, two corresponding spatial light modulators (SLMs) 820, a lamp 830, a plurality of mirrors 840, and a plurality of beam splitters 850. The lamp 830 produces a beam of white light. The beam is reflected off a first mirror 840 and directed towards a first beam splitter 850. The beam is split with a first portion of the beam being directed through a first RGB LCD panel 810(0) and a first SLM 820(0) (i.e., a first projector) and a second portion of the beam directed through a second RGB LCD panel 810(1) and a second SLM 820(1) (i.e., a second projector). The path of the second portion of the beam may be redirected using one or more additional mirrors 840.

The RGB LCD panels 810 are low-resolution, color LCD panels that are configured to modulate the color of the light that is transmitted through each of the liquid crystal elements. Each liquid crystal element may also be overlaid by a color filter for filtering the white light into one of the three different primary colors (e.g., red, green, or blue light). The effect of the RGB LCD panels 810 is to produce a low-resolution color image from the beam of white light that is then projected through the SLMs 820. The SLMs 820 are high-resolution monochromatic panels that are configured to modulate the brightness of the light passing through each element of the SLM 820. The SLMs 820 are a higher resolution than the RGB LCDs 810. In one embodiment, the RGB LCDs 810 have a resolution of 128×96 pixels while the SLMs 820 have a resolution of 1024×768 pixels. It will be appreciated that the RGB LCDs 810 are low-resolution layers of the projectors and the SLMs 820 are high-resolution layers of the projectors. In other words, the RGB LCDs 810 are configured to display low-resolution chroma information for a particular sub-frame and the SLMs 820 are configured to display high-resolution luminance information for the particular sub-frame.

Unlike the display 700, which can only display one sub-frame corresponding to one mixed-primary color component at a time, the display 800 may display two sub-frames corresponding to two mixed-primary color components at a time. In other words, the display 800 operates using a spatial superposition technique where a beam splitter 850 superimposes the projected images from two different projectors onto a screen. Thus, the image created by a first RGB LCD 810(0) and a first SLM 820(0) pair (i.e., the first projector) is combined with an image created by a second RGB LCD 810(1) and a second SLM 820(1) pair (i.e., the second projector). The mixed-primary display 800 may be operated at lower refresh rates than the display 700 because both sub-frames are displayed simultaneously.

Figure 9:
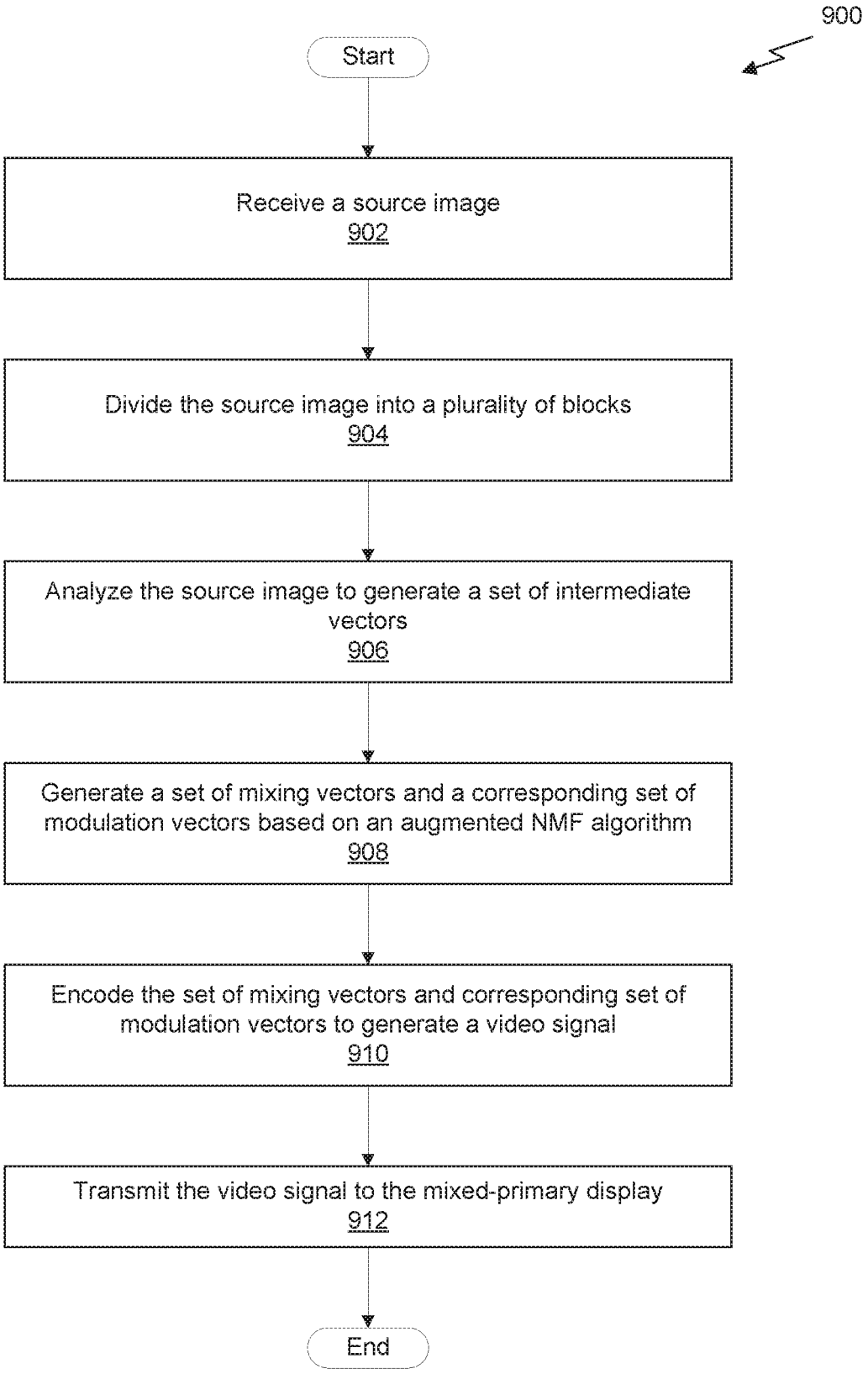
FIG. 9 illustrates a flowchart of a method for generating image data for a mixed primary display, in accordance with another embodiment.

FIG. 9 illustrates a flowchart of a method 900 for generating image data for a mixed-primary display, in accordance with another embodiment. Again, various image decomposition algorithms may be implemented in order to select the mixed-primary color components for each block 752 of the source image 750. Example image decomposition algorithms may include a 2-means algorithm, a robust NMF algorithm, a principal component analysis (PCA) algorithm, a Gaussian mixture model (GMM) algorithm, and a custom linear solver algorithm. In one embodiment, the source image is analyzed to generate chroma information and modulation information using an augmented NMF algorithm.

The emissive spectral distribution of an RGB color display is given by the irradiance:

$$e(x, \lambda) = \sum_{k=1}^{3} i_k(x) f_k(\lambda) \quad \text{(Eq. 1)}$$

where the image i includes three color component channels k (i.e., red, green, blue), each multiplied by a corresponding spectral distribution color light source $f_k$. To model the perceived image for a human eye, under a standard observer model, the International Commission on Illumination (CIE) 1931 standard defines the perceived image $i^{xyz}$ as a projection onto the three color-matching spectral basis functions $\psi^{\overline{xyz}}(\lambda)$:

$$\begin{aligned} i^{xyz}(x) &= \int c(x, \lambda)\psi^{xyz}(\lambda)d\lambda \\ &= \sum_{k=1}^{3} i_k(x) \int f_k(\lambda)\psi^{xyz}(\lambda)d\lambda \end{aligned} \quad \text{(Eq. 2)}$$

By making Equation 2 discrete, the image $I \in \mathbb{R}^{n\times 3}$ may be factored into a more flexible representation using mixed-primary color components and corresponding modulations:

$$I^{xyz} = I^{rgb}F\Psi = \tilde{M}\tilde{P}F\Psi, \quad \text{(Eq. 3)}$$

where the matrix $\Psi \in \mathbb{R}^{L\times 3}$ encodes the spectral color matching functions $\psi^{\overline{xyz}}(\lambda)$, the original spectral distribution of light sources $F \in \mathbb{R}^{3\times L}$ are blended by the primary mixing matrix $\tilde{P} \in \mathbb{R}^{3\times 3}$ such that the multiplication of $\tilde{P}F$ forms new bases for the mixed-primary displays, and the modulation matrix $\tilde{M} \in \mathbb{R}^{n \times 3}$ represents the new coordinates of the pixels on the new mixed-primary axes.

It will be appreciated that the object of the image decomposition algorithm is to find a content-dependent, primary mixing matrix $\tilde{P}$ to capture the intrinsic image statistics that allows for a more succinct representation of the colors in the source image 750 that can potentially reduce the bandwidth required for storing the image I. In order to accomplish this goal, the image I can be factored into a low-rank approximation such that new modulation matrix $M \in \mathbb{R}^{n \times 2}$ and new primary mixing matrix $P \in \mathbb{R}^{2 \times 3}$ minimize the error with respect to the displayed image:

$$\underset{M,\,P}{\arg\min} \|I^{xyz} - MP\Phi\|^2, \tag{Eq. 4}$$

subject to the values of the modulation matrix and the primary mixing matrix are between zero and one, inclusive, where matrix $\Phi = F\psi$ is the RGB-to-XYZ transform, and the non-negativity constraint enforces physically realizable pixel states. Equation 4 simply attempts to minimize the error between the image I and the reproduced image based on the primary mixing matrix P and modulation matrix M. The factorization of the image I is performed in the CIEXYZ color space rather than a native RGB color space. The transformation into the CIEXYZ color space is optional since the transformation is linear and strictly positive. In other embodiments, no transformation may be performed such that the calculation is performed in the RGB color space. In yet other embodiments, different transformations into different color spaces may be performed instead of performing a transformation in the CIEXYZ color space.

In one embodiment, an optimization is performed that takes into account diffusion of light in a diffusion layer 730 between the high-resolution layer 720 and the low-resolution layer 710, which uses a new permutation matrix $\Pi_{\mathcal{N}}$ that includes a normalized Gaussian diffusion kernel into Equation 4, which gives:

$$\underset{M,\,P}{\arg\min} \|I^{xyz} - M\Pi_N P\Phi\|^2 + \gamma\|M_1 - M_2\|^2, \tag{Eq. 5}$$

where $\gamma$ is a regularization constant and $M_1$ and $M_2$ are the two modulation frames. The second term in Equation 5 is added to balance the amount modulation information changes between sub-frames with the choice of mixed-primary color components. The second term helps reduce physical artifacts caused by slow liquid crystal response times by reducing the relative voltage change of liquid crystal elements between sub-frames.

Equation 5, set forth above, is difficult to solve directly because the problem is non-linear. Therefore different techniques may be employed to solve the problem using a parallel processor such as PPU 200. In one embodiment, a perceptual optimization is performed that exploits the opponent theory of human color perception. The opponent theory is that the brain transforms the various signals received from the rods and cones of the eye as luminance and opposing red-green and blue-yellow channels. One way to exploit this model of human perception is to use the CIELab color space, which defines colors as a luminance channel L as well as two color opponent channels a and b. The standard transformation between a CIEXYZ color space and a CIELab color space is given as:

$$\Theta(X) = \begin{cases} L^* = 1160(X^Y/W^Y) - 16 \\ a^* = 500(\theta(X^X/W^X) - \theta(X^Y/W^Y)), \\ b^* = 200(\theta(X^Y/W^Y) - \theta(X^Z/W^Z)) \end{cases} \tag{Eq. 6}$$

where the reference white point under Illuminant D65 is $\langle W^X, W^Y, W^Z \rangle = \langle 0.95047, 1, 1.08883 \rangle$, and:

$$\theta(x) = \begin{cases} x^{\frac{1}{3}} & \text{if } x > \left(\frac{6}{29}\right)^3 \\ \frac{1}{3}\left(\frac{29}{6}\right)^2 x + \frac{4}{29} & \text{otherwise} \end{cases} \tag{Eq. 7}$$

One technique for solving Equation 5 is to split the problem into sub-problems using an intermediate variable T:

$$\underset{T,\,M,\,P}{\arg\min} \|I^{Lab} - \Theta(T)\|^2 + \rho\|I^{xyz} - M\Pi_N P\Phi\|^2 + \gamma\|M_1 - M_2\|^2 \tag{Eq. 8}$$

subject to the values of the modulation matrix M and the primary mixing matrix P are between zero and one, inclusive, where matrix $T = M\Pi_{\mathcal{N}} P\Phi$, and $\rho$ is another regularization constant. With the addition of the first term in Equation 8, the error of the low-rank approximation in the CIELab color space can be minimized by constraining the intermediate variable T. The solution to Equation 8 can be obtained via an Alternating Direction Method of Multipliers (ADMM) described in Boyd et al. ("Distributed optimization and statistical learning via the alternating direction method of multipliers," *Foundations and Trends in Machine Learning,* 3(1), pp. 1-122, 2011), which is incorporated herein in its entirety.

ADMM may be performed by first iteratively solving for T, and then iteratively solving for M and P. The sub-problems are linked via a scaled dual variable U:

$$T \leftarrow \underset{T}{\arg\min} \|I^{Lab} - \Theta(T)\|^2 + \frac{\rho}{2}\|T - M\Pi_N P\Phi + U\|^2 \tag{Eq. 9}$$

$$M, P \leftarrow \underset{M,\,P}{\arg\min} \rho\|I^{xyz} - M\Pi_N P\Phi\|^2 + \gamma\|M_1 - M_2\|^2 + \frac{\rho}{2}\|T - M\Pi_N P\Phi + U\|^2 \tag{Eq. 10}$$

$$U \leftarrow U + (T - M\Pi_N P\Phi) \tag{Eq. 11}$$

Although the sub-problems given by Equations 9, 10, and 11 are still non-trivial, they can be linearized using a Gauss-Newton method and Alternating Least Squares (ALS). This algorithm is highly parallel and may be implemented using the PPU 200. In one embodiment, the first step involves performing a Gauss-Newton iterative algorithm using the PPU 200 to solve for the intermediate variable T. Once the intermediate variable T is solved, then the second step involves solving for M and P using an augmented NMF algorithm implemented by the PPU 200.

The Gauss-Newton iterative algorithm is shown below in Table 1. The method involves, for each pixel j in image I, applying a 3×3 per-pixel transform to a residual vector $r_j$. The transform is derived from the Jacobian $J_{t_j}$ to the first sub-problem. The Gauss-Newton method is performed for a number of iterations, using initialization parameters during the first iteration. In one embodiment, the initialization parameters may be selected as $u_j=0$, $r_j=0$, and $t_j=M\Pi_{\mathcal{N}} P\Phi$.

TABLE 1

$$r_j \leftarrow (i_j^{Lab} - \Theta(t_j)) + \frac{\rho}{2}(t_j - i_j^{rec} + u_j)$$

$$t_j \leftarrow t_j - (J_{t_j}^T J_{t_j})^{-1} J_{t_j} r_j$$

The residual vector $r_j$ is calculated by taking the difference between the pixel value in the image I in the CIELab color space, $i_j^{Lab}$, and the intermediate vector $t_j$ transformed into the CIELab color space. This difference is then added to a normalized sum of the difference between the intermediate vector $t_j$ and a reconstructed pixel value $i_j^{rec}$ added to the vector $u_j$ for the pixel. Once the residual vector $r_j$ has been calculated, the intermediate vector $t_j$ is updated by taking a difference of the intermediate vector $t_j$ and a Jacobian transformation of the residual vector $r_j$. In one embodiment, the Gauss-Newton iterative algorithm may be performed for five iterations to converge on a value for the intermediate vector $t_j$ for each pixel. Of course more or fewer iterations may be performed as well to increase accuracy or speed.

Next, the augmented NMF algorithm is executed for a number of iterations. As used herein, a backlight element n corresponds to a pixel 762 of the low-resolution chroma image 760, and a pixel j corresponds to a pixel 772 of the high-resolution modulation image 770. The backlight elements n also refer to the individual color liquid crystal elements of the low-resolution layer 710 of display 700 or the individual color liquid crystal elements of the RGB LCDs 810 of display 800. The pixels j also refer to the individual monochromatic liquid crystal elements of the high-resolution layer 720 of the display 700 or the individual monochromatic liquid crystal elements of SLMs 820 of display 800.

Table 2 illustrates a modulation matrix update procedure that generates a new modulation vector $m_j$ for each pixel j of the image I for two or more primary color components k. In the modulation matrix update procedure, the summation of the weights $w_j^k$ accounts for 49 neighboring backlight element n (given as $p_n^k$), scaled by the normal distribution based on the distance between a pixel j and the backlights n. The weights help account for diffusion in the diffusion layer 730.

TABLE 2

$$r_j^k \leftarrow \rho(i_j^{rec} - i_j^{xyz}) + \frac{\rho}{2}(i_j^{rec} - t_j + u_j)$$

$$w_j^k \leftarrow \Phi\,(\Sigma_{n \in NeighboriLEDs(j)} \mathcal{N}_{\sigma}^{n,j} p_n^k)$$

$$m_j^k \leftarrow (m_j^k - (r_j^{k^T} w_j^k + \gamma(m_j^k - m_j^k))/w_j^{k^T} w_j^k))$$

Table 3 illustrates a mixed-primary update procedure that generates a new primary mixing vector $p_j$ for each pixel j of the image I. The mixed-primary update procedure is performed in parallel, for each backlight element n. It will be appreciated that a backlight element n corresponds to each pixel element in the low-resolution panel 710 or the RGB LCDs 810. Essentially, a backlight element in corresponds to each pixel 762 in the low-resolution chroma image 760, and each pixel j corresponds to each pixel 772 in the high-resolution luminance image 770. Because the resolution of the chroma image 760 is less than the resolution of the modulation image 770, each backlight element n corresponds to a plurality of pixels j. Furthermore, due to the diffusion layer, each pixel j may cover one or more backlight elements n, as light from two or more backlight elements n will contribute to the light through a pixel j. The set of pixels covered by a particular backlight element n will be based on a distance from the center of backlight element in to the center of each of the pixels. Pixels within a threshold distance of the backlight element n will "cover" the backlight element n.

TABLE 3 for all j ∈ Cover(n) do $$r_j^k \leftarrow \rho(i_j^{rec} - i_j^{xyz}) + \frac{\rho}{2}(i_j^{rec} - t_j + u_j)$$

$$w_j^k \leftarrow \mathcal{N}_{\sigma}^{n,j} m_j^k$$

end for $$p_n^k \leftarrow (p_n^k - \Sigma_j (\Phi^{-1} (w_j^k r_j^k)/\rho(w_j^k)^2))$$

The augmented NMF algorithm is performed by iteratively updating the primary mixing vector $p_n^k$ for each backlight element n and modulation vector $m_j^k$ for each pixel j, which is performed for the each mixed-primary color component k. This corresponds to iteratively solving for the pair of chroma images 760(0) and 760(1) as well as the pair of modulation images 770(0) and 770(1). In one embodiment, the update operations are performed iteratively 20 times until the mixing vectors $p_n^k$ and modulation vectors $m_j^k$ converge. Of course more or fewer iterations may be performed as well to increase accuracy or speed.

It will be appreciated that the constants ρ and γ are selected based on the particular transformations between color spaces chosen. For a CIEXYZ optimizer that converts colors into the CIELab color space, appropriate values of ρ and γ may be given as:

$$\rho=1.5\times10^5$$

$$\gamma=0.25\times10^4$$

As shown in FIG. 9, the image decomposition algorithm may implement the augmented NMF algorithm, as derived above. At step 902, a source image is received. The source image may include a plurality of pixels in a 2D array having a first resolution; where each pixel in the source image is specified as an RGB value having three components corresponding to a red primary color, a green primary color, and a blue primary color. At step 904, the source image is subdivided into a plurality of blocks. Each block in the source image may be a non-overlapping group of adjacent pixels that correspond to a backlight element n.

At step 906, the source image is analyzed using a Gauss-Newton iterative algorithm to generate a set of intermediate vectors $t_j$. Each intermediate vector $t_j$ corresponds to one pixel j in the image. In one embodiment, the Gauss-Newton algorithm is run for 5 iterations, with the values of the intermediate vectors $t_j$ being updated during each interation. The values of the intermediate vectors $t_j$ will converge after a number of iterations. In other embodiments, the number of iterations may be different, sacrificing accuracy of the algorithm for speed, or vice versa.

At step 908, a set of mixing vectors $p_n^k$ and a corresponding set of modulation vectors $m_j^k$ are generated based on an augmented NMF algorithm that uses the intermediate vectors $t_j$ calculated during step 906. Each mixing vector $p_n^k$ corresponds to one backlight element i and each modulation vector $m_j^k$ corresponds to one pixel j in the image, the vectors being generated for each mixed-primary color component k. In one embodiment, the augmented NMF algorithm is run for 20 iterations, with the values of the set of mixing vectors $p_n^k$ and corresponding set of modulation vectors $m_j^k$ being updated during each iteration. Again, in other embodiments, the number of iterations may be different, sacrificing accuracy of the algorithm for speed, or vice versa.

At step 910, the set of mixing vectors $p_n^k$ and corresponding set of modulation vectors $m_j^k$ are encoded to generate a video signal. At step 912, the video signal is transmitted to the mixed-primary display.

It will be appreciated that, for an image that is 512 pixels by 512 pixels in resolution, the time required to generate the set of mixing vectors $p_n^k$ and corresponding set of modulation vectors $m_j^k$ for two mixed-primary color components may be significant. Some experiments suggest that such data may be generated on the order of 50-75 ms per frame, depending on the available hardware and software optimizations used to implement the algorithm.

In one embodiment, in order to speed up real-time performance for video applications, only one set of mixing vectors $p_n^k$ and one set of modulation vectors $m_j^k$ are calculated for a single mixed-primary color component of each frame of video. The set of mixing vectors $p_n^k$ and set of modulation vectors $m_j^k$ for the other mixed-primary color component are re-used from the previous frame. So as video is received that includes a plurality of frames of image data, each frame is analyzed to generate one set of mixing vectors $p_n^k$ and one set of modulation vectors $m_j^k$ corresponding to either the first mixed-primary color component or the second mixed-primary color component for alternating frames in the sequence of frames. For example, a first frame of video is received, and the method 900 is performed to generate one set of mixing vectors $p_n^0$, which corresponds to a first chroma image 760(0), and a corresponding set of modulation vectors $m_j^0$, which corresponds to a first modulation image 770(0). Then, a second frame of video is received, and the method 900 is performed again to generate one set of mixing vectors vectors $p_n^1$, which corresponds to a second chroma image 760(1), and a corresponding set of modulation vectors $m_j^1$, which corresponds to a second modulation image 770(1). The first set of mixing vectors $p_n^0$ and first set of modulation vectors $m_j^0$ are reused from the first frame when generating the second set of mixing vectors $p_n^1$ and second set of modulation vectors $m_j^1$. It will be appreciated that both sets of mixing vectors $p_n^k$ and sets of modulation vectors $m_j^k$ may be generated for the very first frame of video in the sequence of frames since there is no data associated with a previous frame to be re-used.

With display 700, the first chroma image 760(0) and first modulation image 770(0) are encoded and transmitted to the display 700 in order to update the low-resolution layer 710 and the high-resolution layer 720 during a first duration. Then, the second chroma image 760(1) and second modulation image 770(1) are encoded and transmitted to the display 700 in order to update the low-resolution layer 710 and the high-resolution layer 720 during a second duration, using temporal multiplexing to display the two images in sequence such that the viewer's eyes perceive a combined image that represents an image similar to the second frame during the first and second duration.

With display 800, the first chroma image 760(0) and first modulation image 770(0) are encoded and transmitted to the display 800 in order to update the first RGB LCD 810(0) and the first SLM 820(0), respectively, and the second chroma image 760(1) and second modulation image 770(1) are encoded and transmitted to the display 800 in order to update the second RGB LCD 810(1) and the second SLM 820(1), respectively. The projected images from the two projectors are superimposed and perceived as a single frame by a viewer.

As a third frame is received, and the method 900 is performed again to generate one set of mixing vectors vectors $p_n^0$, which corresponds to a first chroma image 760(0), and a corresponding set of modulation vectors $m_j^0$, which corresponds to a first modulation image 770(0). With display 700, the first chroma image 760(0) and the first modulation image 770(0) associated with the third frame are encoded and transmitted to the display 700 in order to update the low-resolution layer 710 and the high-resolution layer 720 during a third duration. Then, the second chroma image 760(1) and second modulation image 770(1) associated with the second frame are reused to update the low-resolution layer 710 and the high-resolution layer 720 during a fourth duration. The viewer's eyes perceive a combined image that represents an image similar to the third frame during the third and fourth duration. In other words, the low-resolution layer 710 and the high-resolution layer 720 are updated twice per frame, using new data from the new frame as well as old data from the previous frame. With display 800, the first chroma image 760(0) and first modulation image 770(0) associated with the third frame are encoded and transmitted to the display 800 in order to update the first RGB LCD 810(0) and the first SLM 820(0), leaving the second RGB LCD 810(1) and the second SLM 820(1) to continue to display the second chroma image 760(1) and second modulation image 770(1) associated with the second frame. In other words, only one projector in the set of projectors is updated per frame.

It will be appreciated that such techniques could be applied to displays using more than two mixed-primary color components per frame (e.g., three mixed-primary color components, four mixed-primary color components, etc.). In addition, some embodiments may utilize existing compression techniques in order to enhance the efficiency of the algorithm. In one embodiment, the chroma images 760 and modulation images 770 may be compressed for transmission to the display. In another embodiment, the blocks 752 of the source image 750 may be stored as texture maps, which may be sampled using existing hardware of the PPU 200 when implementing the algorithms described above. Such texture maps may additionally be compressed using, e.g., DXTC or other formats that support texture compression.

Figure 10:
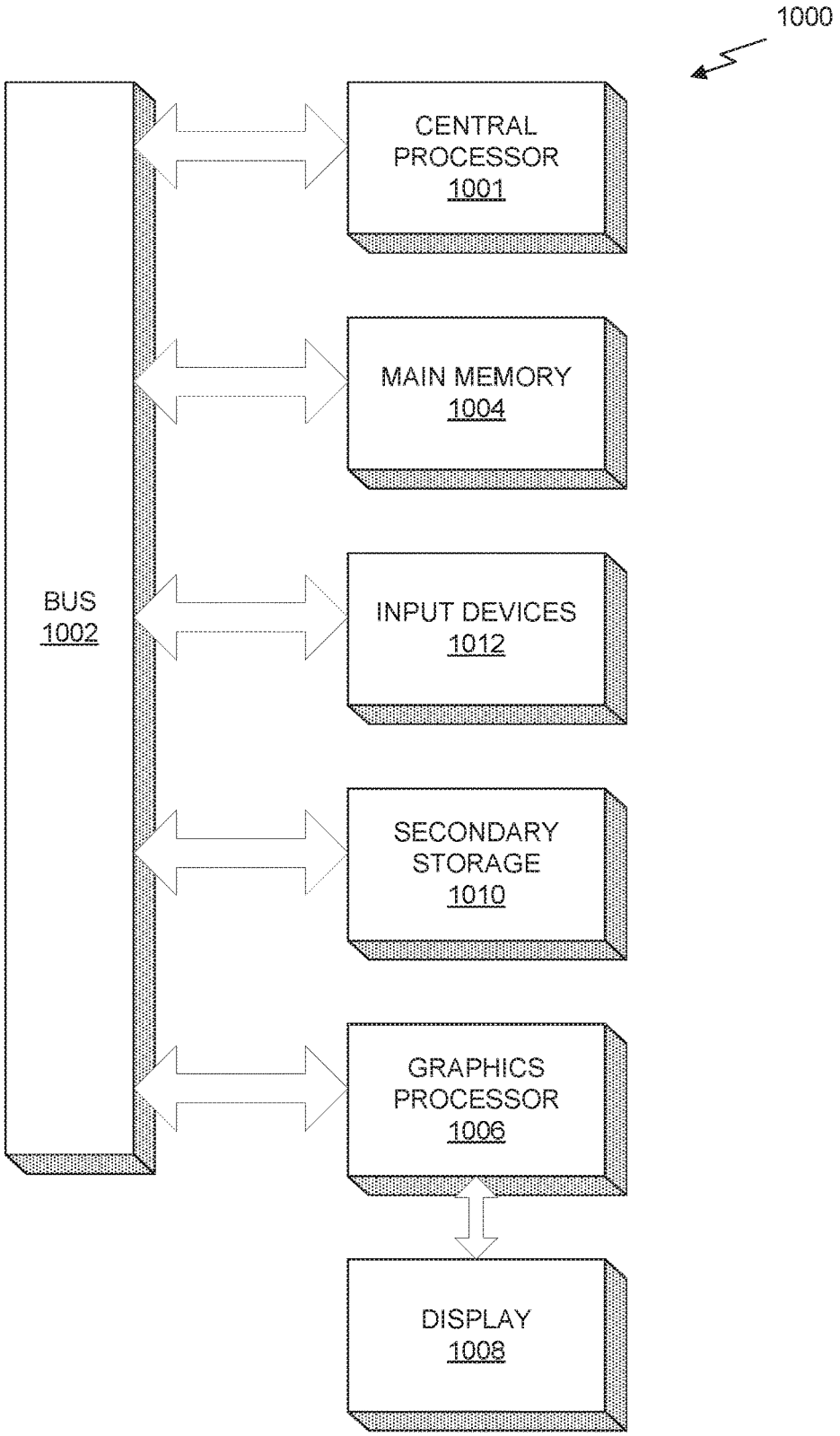
FIG. 10 illustrates an exemplary system in which the various architecture and/or functionality of the various previous embodiments may be implemented.

FIG. 10 illustrates an exemplary system 1000 in which the various architecture and/or functionality of the various previous embodiments may be implemented. As shown, a system 1000 is provided including at least one central processor 1001 that is connected to a communication bus 1002. The communication bus 1002 may be implemented using any suitable protocol, such as PCI (Peripheral Component Interconnect), PCI-Express, AGP (Accelerated Graphics Port), HyperTransport, or any other bus or point-to-point communication protocol(s). The system 1000 also includes a main memory 1004. Control logic (software) and data are stored in the main memory 1004 which may take the form of random access memory (RAM).

The system 1000 also includes input devices 1012, a graphics processor 1006, and a display 1008, i.e. a conventional CRT (cathode ray tube), LCD (liquid crystal display), LED (light emitting diode), plasma display or the like. User input may be received from the input devices 1012, e.g., keyboard, mouse, touchpad, microphone, and the like. In one embodiment, the graphics processor 1006 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 1000 may also include a secondary storage 1010. The secondary storage 1010 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the main memory 1004 and/or the secondary storage 1010. Such computer programs, when executed, enable the system 1000 to perform various functions. The memory 1004, the storage 1010, and/or any other storage are possible examples of computer-readable media.

In one embodiment, the architecture and/or functionality of the various previous figures may be implemented in the context of the central processor 1001, the graphics processor 1006, an integrated circuit (not shown) that is capable of at least a portion of the capabilities of both the central processor 1001 and the graphics processor 1006, a chipset (i.e., a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 1000 may take the form of a desktop computer, laptop computer, server, workstation, game consoles, embedded system, and/or any other type of logic. Still yet, the system 1000 may take the form of various other devices including, but not limited to a personal digital assistant (PDA) device, a mobile phone device, a television, etc.

Further, while not shown, the system 1000 may be coupled to a network (e.g., a telecommunications network, local area network (LAN), wireless network, wide area network (WAN) such as the Internet, peer-to-peer network, cable network, or the like) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

receiving a source image that includes a plurality of pixels;

dividing the source image into a plurality of blocks, each block comprising a plurality of adjacent pixels in the source image;

analyzing the source image based on an image decomposition algorithm to generate, for each sub-frame of two or more sub-frames, each sub-frame of the two or more sub-frames corresponding to a particular mixed-primary color component of two or more mixed-primary color components:

chroma information, and modulation information;

encoding the chroma information and modulation information for each sub-frame of the two or more sub-frames to generate a video signal; and transmitting the video signal to a mixed-primary display configured to reproduce the source image by modulating light in accordance with the two or more sub-frames.

2. The method of claim 1, wherein the mixed-primary display includes a first layer comprising a first array of pixel elements at a first resolution and a second layer comprising a second array of pixel elements at a second resolution, wherein each pixel element of the first layer corresponds with a block of pixels in the plurality of blocks, and wherein each pixel element of the second layer corresponds with a pixel in the source image.

3. The method of claim 2, wherein the first layer comprises:

a backlight that generates white light; and a modulation layer that includes the first array of pixel elements, wherein each pixel element in the first array of pixel elements includes a set of liquid crystal elements, and wherein each liquid crystal element in the set of liquid crystal elements is associated with a particular color filter of a color filter array.

4. The method of claim 2, wherein the mixed-primary display comprises a diffusion layer between the first layer and the second layer.

5. The method of claim 1, wherein the mixed-primary display is configured to reproduce the source image utilizing temporal multiplexing implemented by displaying a first sub-frame associated with a first mixed-primary color component for a first duration and then displaying a second sub-frame associated with a second mixed-primary color component for a second duration.

6. The method of claim 2, wherein the first layer and second layer are included in a first projector, and wherein the mixed-primary display further includes a second projector.

7. The method of claim 6, wherein the first layer is a low-resolution RGB LCD and the second layer is a high-resolution spatial light modulator (SLM).

8. The method of claim 6, wherein the first projector is configured to reproduce a first sub-frame associated with a first mixed-primary color component, the second projector is configured to reproduce a second sub-frame associated with a second mixed-primary color component, and the first sub-frame is superimposed over the second sub-frame using a beam splitter.

9. A method, comprising:

receiving a source image that includes a plurality of pixels;

dividing the source image into a plurality of blocks, each block comprising a plurality of adjacent pixels in the source image;

analyzing the source image based on an image decomposition algorithm to generate chroma information corresponding to two or more mixed-primary color components and modulation information corresponding to the two or more mixed-primary color components, wherein the image decomposition algorithm comprises:

analyzing the image using a Gauss-Newton iterative algorithm to generate a set of intermediate vectors for each pixel of the source image; and generating a set of mixing vectors for each block of the source image and a corresponding set of modulation vectors for each pixel of the source image based on an augmented Non-negative Matrix Factorization (NMF) algorithm that uses the set of intermediate vectors to calculate the set of mixing vectors and the corresponding set of modulation vectors;

encoding the chroma information and modulation information to generate a video signal; and transmitting the video signal to a mixed-primary display.

10. The method of claim 1, wherein the chroma information for a first sub-frame includes a first value for a first mixed-primary color component and the chroma information for a second sub-fame includes a second value for a second mixed-primary color component for each block of the source image, and wherein the modulation information for the first sub-frame includes a first value for the first mixed-primary color component and the modulation information for the second sub-frame includes a second value for the second mixed-primary color component for each pixel of the source image.

11. The method of claim 10, wherein the image decomposition algorithm utilizes the chroma information and modulation information for one mixed-primary color component associated with the source image to generate chroma information and modulation information for a different mixed-primary color component associated with a second source image.

12. A non-transitory, computer-readable storage medium storing instructions that, when executed by a processor, cause the processor to perform steps comprising:

receiving a source image that includes a plurality of pixels;

dividing the source image into a plurality of blocks, each block comprising a plurality of adjacent pixels in the source image;

analyzing the source image based on an image decomposition algorithm to generate, for each sub-frame of two or more sub-frames, each sub-frame of the two or more sub-frames corresponding to a particular mixed-primary color component of two or more mixed-primary color components:

chroma information, and modulation information;

encoding the chroma information and modulation information for each sub-frame of the two or more sub-frames to generate a video signal; and transmitting the video signal to a mixed-primary display configured to reproduce the source image by modulating light in accordance with the two or more sub-frames.

13. The computer-readable storage medium of claim 12, wherein the mixed-primary display includes a first layer comprising a first array of pixel elements at a first resolution and a second layer comprising a second array of pixel elements at a second resolution, wherein each pixel element of the first layer corresponds with a block of pixels in the plurality of blocks, and wherein each pixel element of the second layer corresponds with a pixel in the source image.

14. A system, comprising:

a mixed-primary display configured to reproduce a source image by modulating light in accordance with two or more sub-frames associated with different mixed-primary components; and a parallel processing unit configured to:

receive the source image, wherein the source image includes a plurality of pixels, divide the source image into a plurality of blocks, each block comprising a plurality of adjacent pixels in the source image, analyze the source image based on an image decomposition algorithm to generate, for each sub-frame of two or more sub-frames, each sub-frame of the two or more sub-frames corresponding to a particular mixed-primary color component of two or more mixed-primary color components:

chroma information, and modulation information, encode the chroma information and modulation information for each sub-frame of the two or more sub-frames to generate a video signal, and transmit the video signal to the mixed-primary display.

15. The system of claim 14, wherein the mixed-primary display includes a first layer comprising a first array of pixel elements at a first resolution and a second layer comprising a second array of pixel elements at a second resolution, wherein each pixel element of the first layer corresponds with a block of pixels in the plurality of blocks, and wherein each pixel element of the second layer corresponds with a pixel in the source image.

16. The system of claim 15, wherein the first layer comprises:

a backlight that generates white light; and a modulation layer that includes the first array of pixel elements, wherein each pixel element in the first array of pixel elements includes a set of liquid crystal elements, and wherein each liquid crystal element in the set of liquid crystal elements is associated with a particular color filter of a color filter array.

17. The system of claim 15, wherein the first layer and second layer are included in a first projector, wherein the mixed-primary display further includes a second projector, and wherein the first layer is a low-resolution RGB LCD and the second layer is a high-resolution spatial light modulator (SLM).

18. A system comprising:

a mixed-primary display; and a parallel processing unit configured to:

receive a source image that includes a plurality of pixels;

divide the source image into a plurality of blocks, each block comprising a plurality of adjacent pixels in the source image;

analyze the source image based on an image decomposition algorithm to generate chroma information corresponding to two or more mixed-primary color components and modulation information corresponding to the two or more mixed-primary color components, wherein the image decomposition algorithm comprises:

analyzing the image using a Gauss-Newton iterative algorithm to generate a set of intermediate vectors for each pixel of the source image; and generating a set of mixing vectors for each block of the source image and a corresponding set of modulation vectors for each pixel of the source image based on an augmented Non-negative Matrix Factorization (NMF) algorithm that uses the set of intermediate vectors to calculate the set of mixing vectors and the corresponding set of modulation vectors;

encode the chroma information and modulation information to generate a video signal, and transmit the video signal to the mixed-primary display.

19. The system of claim 14, wherein the chroma information for a first sub-frame includes a first value for a first mixed-primary color component and the chroma information for a second sub-fame includes a second value for a second mixed-primary color component for each block of the source image, and wherein the modulation information for the first sub-frame includes a first value for the first mixed-primary color component and the modulation information for the second sub-frame includes a second value for the second mixed-primary color component for each pixel of the source image.

20. The system of claim 19, wherein the image decomposition algorithm utilizes the chroma information and modulation information for one mixed-primary color component associated with the source image to generate chroma information and modulation information for a different mixed-primary color component associated with a second source image.

* * * * *